US008475981B2

(12) United States Patent
Hirose et al.

(10) Patent No.: US 8,475,981 B2
(45) Date of Patent: Jul. 2, 2013

(54) IMAGE HOLDING MEMBER FOR IMAGE FORMING APPARATUS, PROCESS CARTRIDGE, AND IMAGE FORMING APPARATUS

(75) Inventors: Hidekazu Hirose, Kanagawa (JP); Takeshi Agata, Kanagawa (JP); Katsuhiro Sato, Kanagawa (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 253 days.

(21) Appl. No.: 13/024,914

(22) Filed: Feb. 10, 2011

(65) Prior Publication Data

US 2012/0015290 A1 Jan. 19, 2012

(30) Foreign Application Priority Data

Jul. 15, 2010 (JP) ..... 2010-161027

(51) Int. Cl.
*G03G 5/00* (2006.01)

(52) U.S. Cl.
USPC ..... 430/58.15; 399/159

(58) Field of Classification Search
USPC ..... 430/58.15; 399/159
See application file for complete search history.

(56) References Cited

U.S. PATENT DOCUMENTS 3,461,165 A 8/1969 Frye
4,047,948 A 9/1977 Horgan (Continued)

FOREIGN PATENT DOCUMENTS

JP A-47-30330 11/1972
JP A-61-132955 6/1986

(Continued)

OTHER PUBLICATIONS

Pang, H. et al., "Advantageous 3D Ordering of π-Conjugated Systems: A New Approach Towards Efficient Charge Transport in any Direction," *Advanced. Materials*, 2007, pp. 4438-4442, vol. 19.

(Continued)

*Primary Examiner* — Mark A Chapman
(74) *Attorney, Agent, or Firm* — Oliff & Berridge, PLC

(57) ABSTRACT

An image holding member for an image forming apparatus is disclosed which the image holding member includes a support and a photosensitive layer disposed on or above the support, the photosensitive layer including a compound including a partial structure represented by the following Formula (A), wherein Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and Each n each independently represent an integer of from 0 to 7.

Formula (A)

5 Claims, 5 Drawing Sheets

U.S. PATENT DOCUMENTS

| | | | |
|---|---|---|---|
| 4,299,897 | A | 11/1981 | Stolka et al. |
| 5,134,049 | A | 7/1992 | Kuroda et al. |
| 5,283,145 | A | 2/1994 | Nukada et al. |
| 5,290,928 | A | 3/1994 | Nukada et al. |
| 5,298,617 | A | 3/1994 | Nukada et al. |
| 5,302,479 | A | 4/1994 | Daimon et al. |
| 5,308,728 | A | 5/1994 | Imai et al. |
| 5,338,636 | A | 8/1994 | Nukada et al. |
| 5,358,813 | A | 10/1994 | Iijima et al. |
| 5,378,569 | A | 1/1995 | Nukada et al. |
| 5,393,629 | A | 2/1995 | Nukada et al. |
| 5,416,207 | A | 5/1995 | Imai et al. |
| 5,459,004 | A | 10/1995 | Daimon et al. |
| 5,463,043 | A | 10/1995 | Nukada et al. |
| 5,639,581 | A | 6/1997 | Iwasaki et al. |
| 5,654,119 | A | 8/1997 | Ishii et al. |
| 5,734,003 | A | 3/1998 | Iwasaki et al. |
| 6,586,148 | B1 | 7/2003 | Graham et al. |
| 7,812,172 | B2 | 10/2010 | Horiba et al. |
| 2004/0086796 | A1 | 5/2004 | Yu et al. |
| 2008/0008952 | A1 | 1/2008 | Lim |
| 2011/0086999 | A1 | 4/2011 | Hirose et al. |

FOREIGN PATENT DOCUMENTS

| | | |
|---|---|---|
| JP | A-62-196666 | 8/1987 |
| JP | A-62-267749 | 11/1987 |
| JP | A-63-280255 | 11/1988 |
| JP | A-3-138654 | 6/1991 |
| JP | A-4-189873 | 7/1992 |
| JP | A-5-43813 | 2/1993 |
| JP | A-5-98181 | 4/1993 |
| JP | A-5-140472 | 6/1993 |
| JP | A-5-140473 | 6/1993 |
| JP | A-5-263007 | 10/1993 |
| JP | A-5-279591 | 10/1993 |
| JP | A-8-176293 | 7/1996 |
| JP | A-8-208820 | 8/1996 |
| JP | A-2009224662 | 1/2009 |

OTHER PUBLICATIONS

U.S. Appl. No. 12/877,603, filed Sep. 8, 2010, in the name of Hidekazu Hirose et al.

"Jikken Kagaku Koza," *The Fourth Series of Experimental Chemistry*, 1992, pp. 208-231, vol. 28.

Sep. 24, 2012 Restriction and Election of Species Requirement issued in U.S. Appl. No. 12/877,603.

Nov. 6, 2012 Office Action Issued in U.S. Appl. No. 12/877,603.

Jan. 25, 2013 Office Action Issued in U.S. Appl. No. 12/877,603.

IMAGE HOLDING MEMBER FOR IMAGE FORMING APPARATUS, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-161027, filed on Jul. 15, 2010.

BACKGROUND

1. Technical Field

The present invention relates to an image holding member for an image forming apparatus, a process cartridge, and an image forming apparatus.

2. Related Art

A photoreceptor having a photosensitive layer including an organic photoconductive compound as a main component has been actively studied since, compared with a conventionally used photoreceptor including an inorganic photoconductor (selenium, zinc oxide, cadmium sulfide, silicon, or the like) as a main component, it has a number of advantages, such as ease of preparation, relatively low cost, ease of handling, excellent thermal stability, and the like, as.

In particular, a photoreceptor including a function separation type photosensitive layer having a multiple-layer structure, in which a charge generating function and a charge transporting function of the photoconductor are assigned, respectively, to the respective separate functional layers, and a material having a function of generating charges and a material having a function of transporting the charges are incorporated into a charge generating layer and a charge transporting layer, respectively, has already been put to practical use.

SUMMARY

According to an aspect of the present invention, an image holding member for an image forming apparatus is provided, the image holding member including a support and a photosensitive layer disposed on or above the support, and the photosensitive layer including a compound including a partial structure represented by the following Formula (A).

BRIEF DESCRIPTION OF THE DRAWINGS

Exemplary embodiments of the present invention are described in detail based on the following figures, wherein.

DETAILED DESCRIPTION

Figure 1:
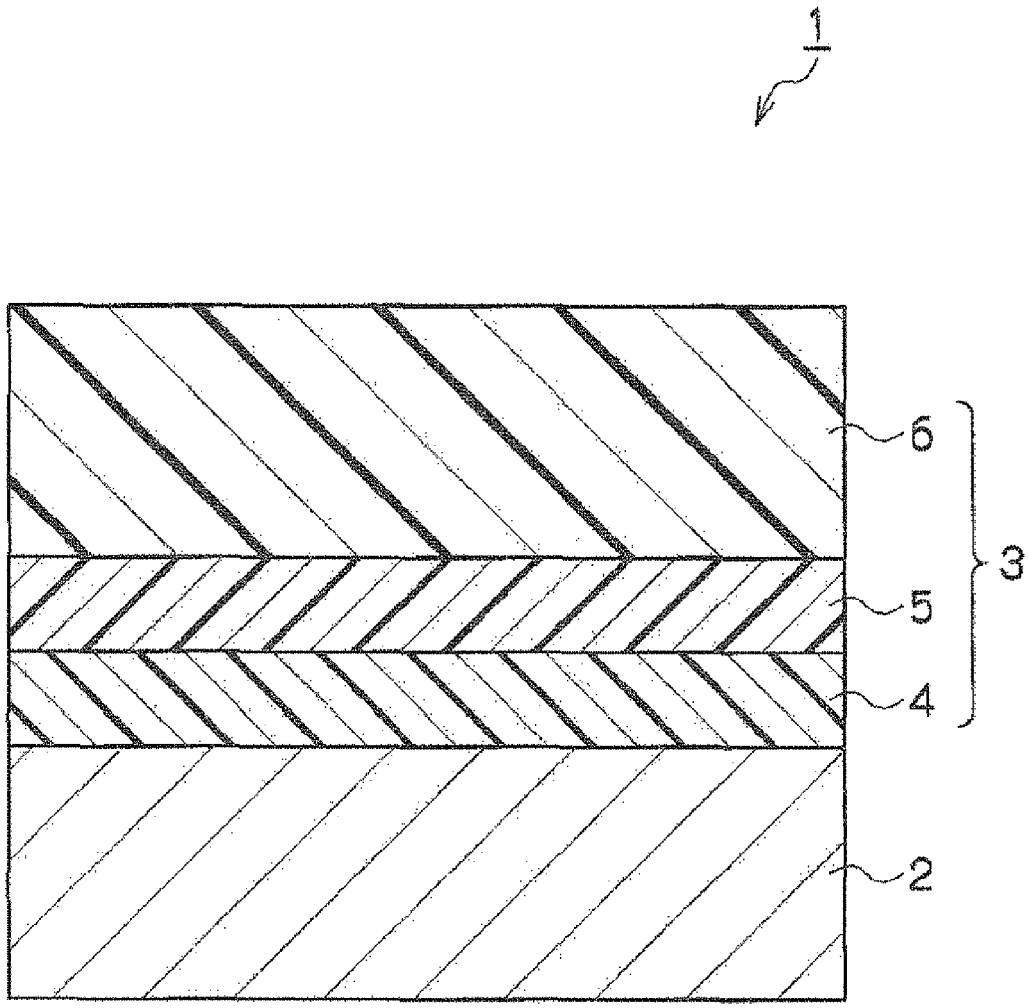
FIG. 1 is a schematic cross-sectional view of an image holding member for an image forming apparatus according to an exemplary embodiment.

Hereinbelow, exemplary embodiments of the present invention are described.

In the present exemplary embodiment, an image holding member for an image forming apparatus is provided in which a compound including a partial structure represented by Formula (A) is used as a charge transporting material. That is, in the present exemplary embodiment, an image holding member for an image forming apparatus is provided. The image holding member for an image forming apparatus includes a support (for example, a conductive support) and a photosensitive layer disposed on or above the support, and the photosensitive layer including a compound including a partial structure represented by Formula (A).

The compound including a partial structure represented by Formula (A) may be, for example, a compound represented by Formula (I) or a compound represented by Formula (II-1). In the image holding member for an image forming apparatus, the photosensitive layer may includes at least one compound selected from a group consisting of a compound represented by Formula (I) and a compound represented by Formula (II-1).

The compound including a partial structure represented by Formula (A), the compound represented by Formula (I), the compound represented by Formula (II-1) are described in detail below.

Formula (A)

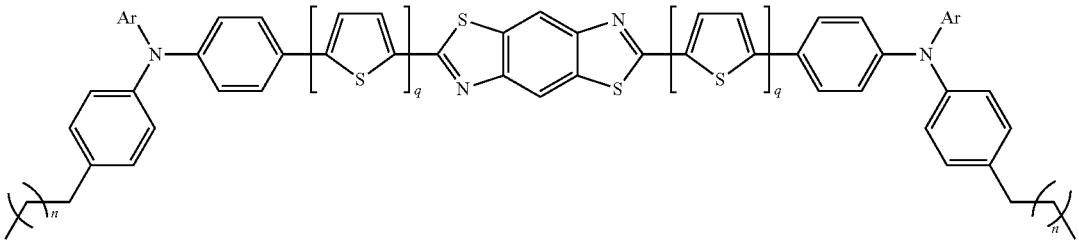

In Formula (A), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and each n independently represents an integer of from 0 to 7.

The term "conductive support" used in the present exemplary embodiments refers to a support having a surface volume resistivity, measured in accordance with JIS K 7194 "Testing method for resistivity of conductive plastics with a four-point probe array", of less than $10^7$ Ω·cm. The disclosure of JIS K 7194 is incorporated by reference herein. That is, the conductive support may be a support formed with conductive materials having a volume resistivity measured in accordance with the above-described method of less than $10^7$ Ω·cm or may be a support having a conductive layer formed with the conductive materials on the substrate surface.

The photosensitive layer in the image holding member for an image forming apparatus may be a single-layer type photosensitive layer including a charge generating materials and a charge transporting material in the same layer. Alternatively, the photosensitive layer in the image holding member for an image forming apparatus may be a functional separation type photosensitive layer including a layer containing a charge generating material and a layer containing a charge transporting material, these layers being adjacent to each other to be provided separately. In the photosensitive layer in the image holding member for an image forming apparatus, a compound including a partial structure represented by Formula (A) is included as a charge transporting material.

As the charge generating material, any known charge generating material such as oxytitanium phthalocyanine, chlorogallium phthalocyanine, hydroxygallium phthalocyanine, or the like can be used. The image holding member for an image forming apparatus may further include a protective layer on the outermost surface (located farthest from the support), and the protective layer in this case preferably contains a crosslinkable silicone resin having a charge transporting property.

Image Holding Member for Image Forming Apparatus

The image holding member for an image forming apparatus according to the present exemplary embodiment includes a support and, a photosensitive layer including a partial structure represented by Formula (A) disposed on or above the support. The compound including a partial structure represented by Formula (A) may be, for example, a compound represented by Formula (I) or a compound represented by Formula (II-1). The image holding member for an image forming apparatus according to the present exemplary embodiment may be, for example, an image holding member including a photosensitive layer including at least one compound selected from the group consisting of compounds represented by Formula (I) and compounds represented by Formula (II-1).

<Compound Represented by Formula (A)>

Hereinbelow, the compound represented by the following Formula (A) is described in detail.

In Formula (A), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group, q represents 0 or 1, and each n independently represents an integer of from 0 to 7.

That is, Ar, q and n in Formula (A) have the same definition as Ar, q and n in Formula (I) respectively, which are described below, and also have the same preferable definition as Ar, q and n in Formula (I) respectively.

<Compound Represented by Formula (I)>

Hereinbelow, the compound represented by the following Formula (I) is described in detail.

Formula (I)

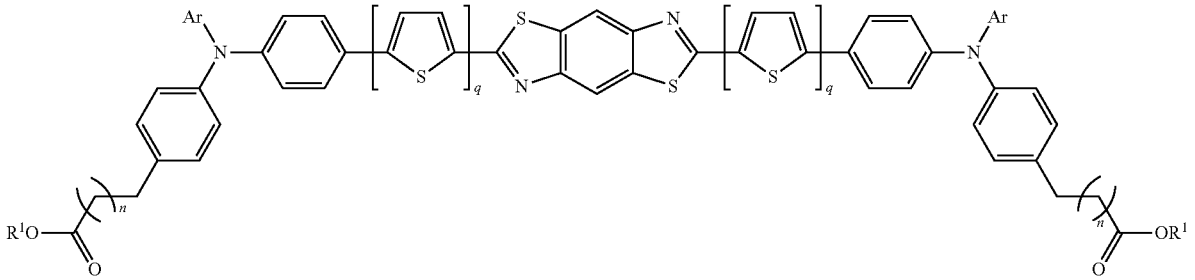

In Formula (I), each $R^1$ independently represents a substituted or unsubstituted linear or branched alkyl group having from 1 to 8 carbon atoms, Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group, q represents 0 or 1, and each n independently represents an integer of from 0 to 7.

$R^1$ in Formula (I) is described.

As described above, $R^1$'s Formula (I) each independently represent a substituted or unsubstituted linear or branched alkyl group having from 1 to 8 carbon atoms.

The alkyl groups represented by $R^1$ each independently preferably has from 1 to 6 carbon atoms, and more preferably from 1 to 4 carbon atoms.

The alkyl group represented by $R^1$ is linear or branched, and from the viewpoints of maintenance of crystallinity and solubility, it is preferably a linear alkyl group.

In Formula (I), when the alkyl group represented by $R^1$ has a substituent, examples of the substituent include an aryl group or a heterocycle group.

Formula (A)

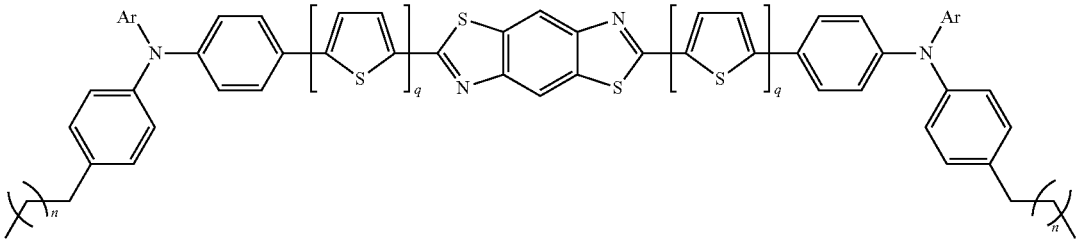

The aryl group as the substituent preferably has from 6 to 20 carbon atoms, and examples thereof include a phenyl group, tolyl group, a naphthyl group, and the like.

The heterocycle of the heterocycle group as the substituent represents a ring containing atoms other than carbon and hydrogen atoms. The heterocycle preferably has the number of atoms constituting the ring skeleton (Nr) of 5 or 6. Although the kind and number of the atoms other than carbon atoms contained in a ring skeleton thereof (hetero atoms) are not particularly limited, for example, a sulfur atom, a nitrogen atom, an oxygen atom, a selenium atom, a silicon atom, a phosphorous atom, or the like is preferably used. The ring skeleton of the heterocycle may have two or more different kinds of hetero atoms. The ring skeleton of the heterocycle may have two or more hetero atoms.

Preferable examples of the 5-membered heterocycle include thiophene, pyrrole, furan, imidazole, oxazole, selenophene, thiazole, thiadiazole, pyrazole, isoxazole, isothiazole, silole, and heterocycles in which carbon atoms at the 3rd position and the 4th position of the compound is replaced with nitrogen atoms. Examples of the aromatic heterocycle having the 5-membered heterocycle further include benzothiophene, benzimidazole, indole, and the like.

Preferable examples of the 6-membered heterocycle include pyridine, pyrimidine, pyrazine, and piperazine.

Further, examples of the heterocycle of the heterocycle group as the substituent include a heterocycle which has an aromatic ring as a substituent thereof, and an aromatic ring which has a heterocycle as a substituent thereof.

Specific examples of the alkyl group represented by $R^1$ in Formula (I) include a methyl group, an ethyl group, a propyl group, an n-butyl group, a t-butyl group, an n-hexyl group, and an n-octyl group, preferably a methyl group, an ethyl group, a propyl group, an n-butyl group, a t-butyl group, an n-hexyl group, and an n-octyl group, and more preferably a methyl group and a butyl group, and from the viewpoints of easy preparation and maintenance of crystallinity, a methyl group or a butyl group is further preferable, and from the viewpoints of availability, a methyl group is even further preferable.

$R^1$ is a substituted or unsubstituted, linear or branched alkyl group having from 1 to 8 carbon atoms, and within this range, there effects on ionization potentials or a charge transporting property due to difference in the kind of alkyl groups may be small.

Furthermore, plural $R^1$'s in Formula (I) may be the same as or different from each other, but they are preferably the same as each other from the viewpoints of preparation.

Ar in Formula (I) is described.

In Formula (I), Ar represents a substituted or unsubstituted phenyl group, a substituted or unsubstituted, monovalent polynuclear aromatic hydrocarbon group having from 2 to 10 aromatic rings, a substituted or unsubstituted, monovalent condensed aromatic hydrocarbon group having from 2 to 10 aromatic rings, or a substituted or unsubstituted monovalent aromatic heterocyclic group.

Herein, the "polynuclear aromatic hydrocarbon group" and the "condensed aromatic hydrocarbon group" are groups in which two or more rings selected from the group consisting of aromatic rings composed of carbon and hydrogen atoms, and heterocycles as described later. The polynuclear aromatic hydrocarbon group and the condensed aromatic hydrocarbon group are more specifically described in the following.

The "polynuclear aromatic hydrocarbon group" represents a hydrocarbon group in which two or more rings selected from the group consisting of aromatic rings composed of carbon and hydrogen atoms, and heterocycles as described later, and the rings bind to each other by a carbon-carbon bond. Specific examples thereof include hydrocarbon groups in which carbon atoms contained in the aromatic rings bind to each other directly by a carbon-carbon bond, or in which aromatic rings bind to each other by a carbon chain (alkyl chain or alkylene chain) having 1 to 18 carbon atoms, and the like.

Specific examples of the polynuclear aromatic hydrocarbon group include substituents formed of a polynuclear aromatic hydrocarbon, such as biphenyl, terphenyl, stilbene, triphenylethylene, or the like. The polynuclear aromatic hydrocarbon group may be, for examples, a substituent formed of biphenyl, that is, a biphenylene group.

Further, the ring that is a component for forming the polynuclear aromatic hydrocarbon group may be a condensed aromatic hydrocarbon group or an aromatic heterocycle, as described later. Specific examples of the condensed aromatic hydrocarbon group and the aromatic heterocycle group which may be used as a component for forming the polynuclear aromatic hydrocarbon group include those of the specific exemplary compounds as described later.

The "condensed aromatic hydrocarbon group" represents a hydrocarbon group in which two or more rings selected from the group consisting of aromatic rings composed of carbon and hydrogen atoms, and heterocycles as described later, and a pair of carbon atoms are shared by the adjacent rings binding to each other. Specific examples thereof include substituents formed of naphthalene, anthracene, phenanthrane, pyrene, perylene, fluorene, or the like. The "condensed aromatic hydrocarbon group" may be, for example, a substituent formed of naphthalene, that is, a naphthyl group.

The "aromatic heterocycle" represents an aromatic ring containing atoms other than carbon and hydrogen atoms. The aromatic heterocyclic group is a substituent formed of an aromatic heterocycle.

The number (Nr) of atoms constituting the ring skeleton of the aromatic heterocycle (Nr) may be, for example, Nr=5, Nr=6, or the like. Further, the kind and the number of the atom other than carbon atoms contained in the ring skeleton (hetero atoms) are not limited. Examples of the hetero atom include a sulfur atom, a nitrogen atom, an oxygen atom, a selenium atom, a silicon atom, a phosphorous atom, and the like. The aromatic heterocycle may contain two or more hetero atoms in a ring skeleton. The aromatic heterocycle may contain two or more different kinds of hetero atoms in a ring skeleton.

Examples of the heterocycle having a ring skeleton structure with Nr=5 (that is, a 5-membered ring structure) include thiophene, thiophine, pyrrole, furan, imidazole, oxazole, selenophene, thiazole, thiadiazole, pyrazole, isoxazole, isothiazole, silole, heterocycles in which carbon atoms at the 3rd position and the 4th position of the compound are replaced with nitrogen atoms, and the like. Examples of the heterocycle having a 5-membered ring structure further include benzothiophene, benzimidazole, indole, and the like.

Furthermore, examples of the heterocycle having a ring skeleton structure with Nr=6 (that is, a 6-membered ring structure) include pyridine, pyrimidine, pyrazine, piperazine, and the like.

In the "substituted or unsubstituted monovalent aromatic group" as described above, examples of the substituent that may be used for substituting the aromatic group include a hydrogen atom, an alkyl group, an alkoxy group, a phenoxy group, an aryl group, an aralkyl group, a substituted amino group, a halogen atom, and the like, and preferable examples include a hydrogen atom, an alkyl group, an alkoxy group, and the like.

Examples of the alkyl group include those having 1 to 10 carbon atoms, and specific examples thereof include a methyl group, an ethyl group, a propyl group, an isopropyl group, and the like.

Examples of the alkoxy group include those having 1 to 10 carbon atoms, and specific examples thereof include a methoxy group, an ethoxy group, a propoxy group, an isopropoxy group, and the like.

Examples of the aryl group include those having 6 to 20 carbon atoms, and specific examples thereof include a phenyl group, a tolyl group, and the like.

Examples of the aralkyl group include those having 7 to 20 carbon atoms, and specific examples thereof include a benzyl group, a phenethyl group, and the like.

Examples of the substituent that may be used for the substituted amino group include an alkyl group, an aryl group, and an aralkyl group, and specific examples of the alkyl group, the aryl group, and the aralkyl group are as described above. Specific examples of the substituted amino group include a diphenylamino group and the like.

Preferable examples of Ar in Formula (I) include, among those as described above, a substituted or unsubstituted phenyl group, a substituted or unsubstituted polynuclear aromatic hydrocarbon group, and a substituted or unsubstituted condensed aromatic hydrocarbon group, more preferable examples of Ar in Formula (I) include a substituted or unsubstituted phenyl group, a substituted or unsubstituted polynuclear aromatic hydrocarbon group containing none of a condensed aromatic hydrocarbon group and aromatic heterocycle, and a substituted or unsubstituted condensed aromatic hydrocarbon group, and still more preferable examples of Ar in Formula (I) include a substituted or unsubstituted phenyl group, a substituted or unsubstituted polynuclear aromatic hydrocarbon group in which carbon atoms contained in the aromatic ring bind to each other directly by a carbon-carbon bond, and a substituted or unsubstituted condensed aromatic hydrocarbon group.

The number of aromatic rings in Ar in Formula (I) is preferably from 1 to 6, more preferably from 1 to 3, and further preferably 1 or 2, from the viewpoints of compatibility with a resin. That is, as Ar in Formula (I), a substituted or unsubstituted phenyl group, a substituted or unsubstituted biphenylene group, or a substituted or unsubstituted naphthyl group is more preferable, and an unsubstituted phenyl group, an unsubstituted biphenylene group or an unsubstituted naphthyl group is further preferable.

q and n in Formula (I) are described.

q in Formula (I) is 0 or 1. The compound of Formula (I) in which q is 1 may have a higher charge transporting property than that of the compound of Formula (I) in which q is 0, but from the viewpoints of the stability of the compound and ease of synthesis, q is preferably 0. The compound of Formula (I) in which q is 0 does not have a thiophene skeleton that may be easily oxidized and, therefore the stability of the compound may be higher, as compared with the compound in which q is 1, and an image holding member for forming an image using the compound may have higher durability, as compared when using the compound in which q is 1.

In particular, the compound of Formula (I) in which q is 0 may attain a good charge transporting property and good stability as above, as compared with, for example, the compound of Formula (I) in which q is 1 (that is, which has two thiophene skeletons) and which has no a dibenzothiazole skeleton.

Each n in Formula (I) is independently from 0 to 7. Two n's in Formula (I) may be the same as or different from each other, but are preferably the same as each other from the viewpoints of preparation. A smaller n in Formula (I) is preferred from the viewpoints of the charge transporting property, but if n is too small, the charge mobility decreases due to the effect of the dipole moment of a carbonyl group, and thus, n is preferably from 1 to 3, and more preferably 1.

The compound represented by Formula (I) has an amino group which has strong electron accepting property such that the amino group directly or via a thiophene skeleton bonded to the benzobisthiazole skeleton. Accordingly, it is thought that a wider range of a π conjugation may promote the improvement of the charge mobility, the amorphous property may also be improved, and thus, the dispersibility in a resin may become improved.

Hereinbelow, Specific Exemplary Compound 1 through 36 (the compounds of Specific Exemplary Compound No. 1 through Specific Exemplary Compound No. 36 in Tables below) of the benzobisthiadiazole compound represented by Formula (I) are shown, but the compound of Formula (I) is not be limited thereto.

$R^1$, Ar, q, and n in Specific Exemplary Compounds 1 to 36 represent $R^1$, Ar, q, and n in Formula (I), respectively.

| Specific Exemplary Compound No. | Ar | n | q | $R^1$ |
|---|---|---|---|---|
| 1 | 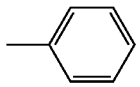 | 0 | 0 | $CH_3$ |
| 2 | 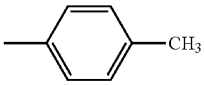 | 0 | 0 | $CH_3$ |
| 3 | 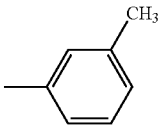 | 0 | 0 | $CH_3$ |
| 4 | 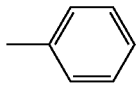 | 1 | 0 | $CH_3$ |
| 5 | 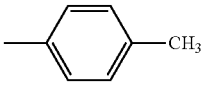 | 1 | 0 | $CH_3$ |
| 6 | 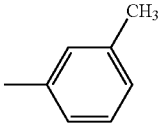 | 1 | 0 | $CH_3$ |
| 7 | 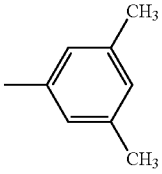 | 1 | 0 | $CH_3$ |
| 8 | 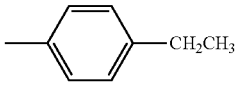 | 1 | 0 | $CH_3$ |
| 9 | 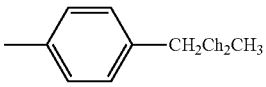 | 1 | 0 | $CH_3$ |
| 10 | 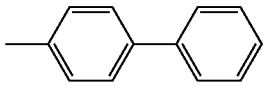 | 1 | 0 | $CH_3$ |

-continued
| Specific Exemplary Compound No. | Ar | n | q | $R^1$ |
|---|---|---|---|---|
| 11 | 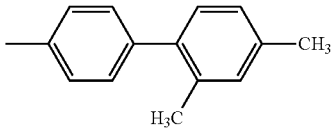 | 1 | 0 | $CH_3$ |
| 12 | 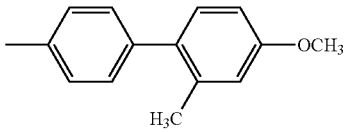 | 1 | 0 | $CH_3$ |
| 13 | 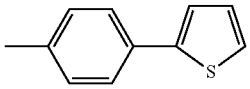 | 1 | 0 | $CH_3$ |
| 14 | 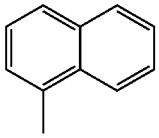 | 1 | 0 | $CH_3$ |
| 15 | 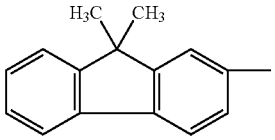 | 1 | 0 | $CH_3$ |
| 16 | 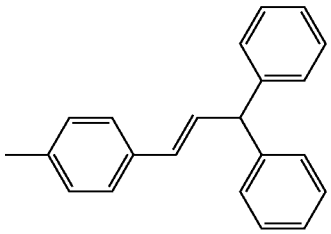 | 1 | 0 | $CH_3$ |
| 17 | 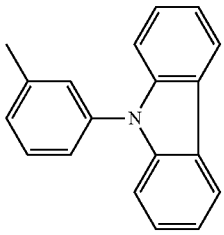 | 1 | 0 | $CH_3$ |
| 18 | 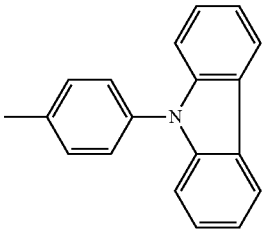 | 1 | 0 | $CH_3$ |
-continued
| Specific Exemplary Compound No. | Ar | n | q | $R^1$ |
|---|---|---|---|---|
| 19 | 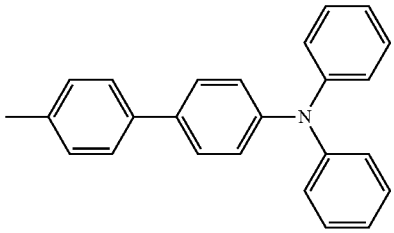 | 1 | 0 | $CH_3$ |
| 20 | 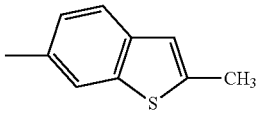 | 1 | 0 | $CH_3$ |
| 21 | 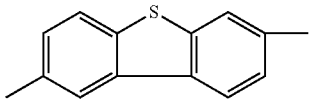 | 1 | 0 | $CH_3$ |
| 22 | 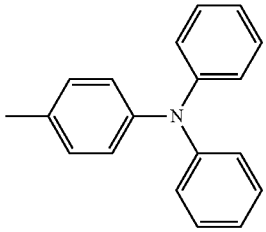 | 1 | 0 | $CH_3$ |
| 23 | 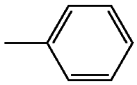 | 1 | 1 | $CH_3$ |
| 24 | 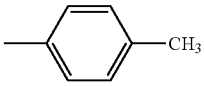 | 1 | 1 | $CH_3$ |
| 25 | 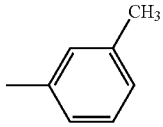 | 1 | 1 | $CH_3$ |
| 26 | 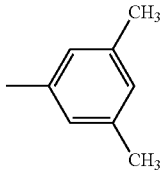 | 1 | 1 | $CH_3$ |
| 27 | 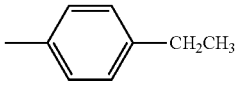 | 1 | 1 | $CH_3$ |
| 28 | 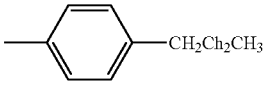 | 1 | 1 | $CH_3$ |

-continued

| Specific Exemplary Compound No. | Ar | n | q | $R^1$ |
|---|---|---|---|---|
| 29 | 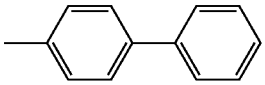 | 1 | 1 | $CH_3$ |
| 30 | 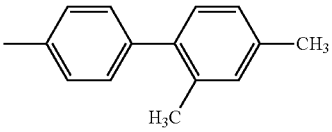 | 1 | 1 | $CH_3$ |
| 31 | 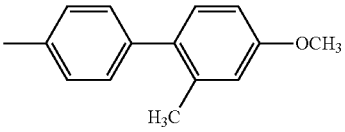 | 1 | 1 | $CH_3$ |
| 32 | 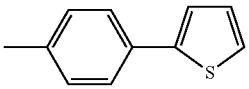 | 1 | 1 | $CH_3$ |
| 33 | 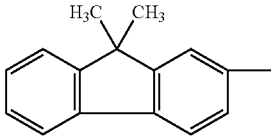 | 1 | 1 | $CH_3$ |
| 34 | 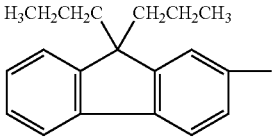 | 1 | 1 | $CH_3$ |
| 35 | 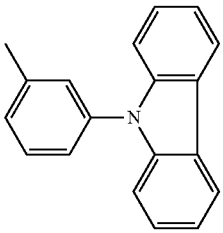 | 1 | 1 | $CH_3$ |
| 36 | 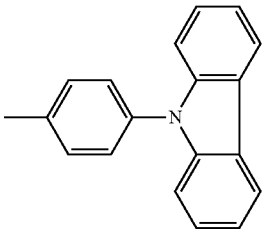 | 1 | 1 | $CH_3$ |

<Method for Preparing Compound Represented by Formula (I)>

Hereinbelow, the method for preparing the compound represented by Formula (I) is described in detail.

In the present exemplary embodiment, a triarylamine derivative represented by the following Formula (VII) can be obtained, for example, by subjecting a halogen compound represented by the following Formula (III) and a diarylamine compound represented by the following Formula (IV) to a coupling reaction with a copper catalyst, by subjecting a diarylamine compound represented by the following Formula (V-1) and a halogen compound represented by the following Formula (VI-1) to a coupling reaction with a copper catalyst, or by subjecting a diarylamine compound represented by the following Formula (V-2) and a halogen compound represented by the following Formula (VI-2) to a coupling reaction with a copper catalyst.

Then, triarylamine (VII) may be reacted with a formylating agent such as N,N-dimethylformamide, N-methylformanilide, and the like in the presence of phosphorous oxychloride to obtain a formylated form (VIII) of a triarylamine derivative. The formylated form (VIII) of the triarylamine derivative may be reacted with a diaminobenzodithiol to obtain a benzobisthiazole compound (IX).

(III)

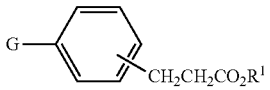

(IV)

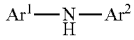

In Formula (III), $R^1$ has the same definitions as $R^1$ in Formula (I) a, and G represents a bromine atom or an iodine atom. Further, in Formula (IV), $Ar^1$ has the same definitions as Ar in Formula (I), and $Ar^2$ represents a phenyl group or a group formed of phenylthiophene.

(V-1)

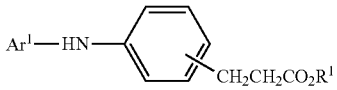

(VI-1)

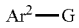

(V-2)

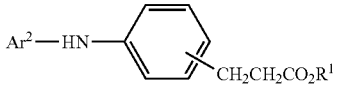

(VI-2)

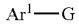

In Formula (V-1), $R^1$ and $Ar^1$ have the same definitions as $R^1$ and $Ar^1$ described above, respectively. Further, in Formula (VI-1), $Ar^2$ and G have the same definitions as $Ar^2$ and G described above, respectively.

In Formula (V-2), $R^1$ and $Ar^2$ have the same definitions as $R^1$ and $Ar^2$ described above, respectively. Further, in Formula (VI-2), $Ar^1$ and G have the same definitions as $Ar^1$ and G described above, respectively.

(VII)

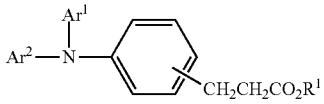

In Formula (VII), $Ar^1$, $Ar^2$, and $R^1$ have the same definitions as $Ar^1$, $Ar^2$, and $R^1$ described above, respectively.

(VIII)

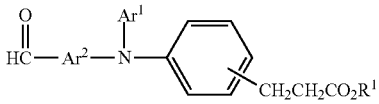

In Formula (VIII), $Ar^1$, $Ar^2$, and $R^1$ have the same definitions as $Ar^1$, $Ar^2$, and $R^1$ described above, respectively.

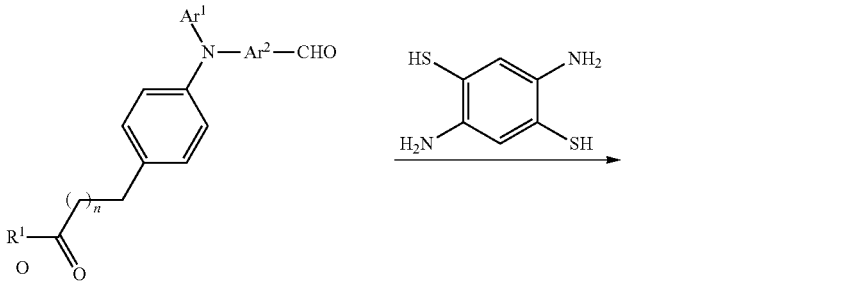

(VIII)

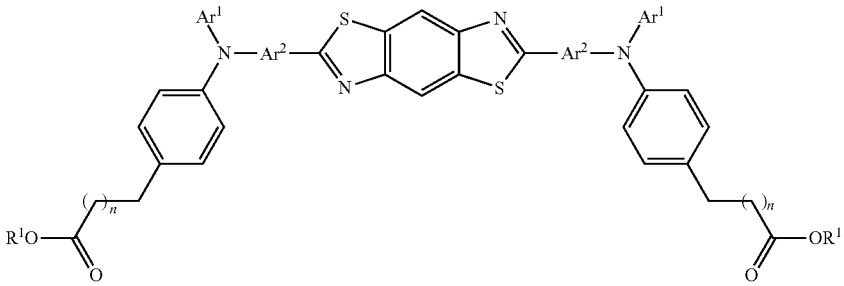

(IX)

In Formula (IX), $Ar^1$, $Ar^2$, and $R^1$ have the same definitions as $Ar^1$, $Ar^2$, and $R^1$ described above, respectively.

For the coupling reaction, a halogen compound represented by Formula (III), (VI-1), or (VI-2) is used in an amount ranging, for example, from 0.5 equivalents to 1.5 equivalents, and preferably from 0.7 equivalents to 1.2 equivalents, relative to 1 equivalent of the compound represented by Formula (IV), (V-1), or (V-2).

Examples of the copper catalyst used in the coupling reaction above include, copper powders, cuprous oxide, copper sulfate, and the like. Further, the copper catalyst is used in an amount ranging, for example, from 0.001 parts by weight to 3 parts by weight, and preferably from 0.01 parts by weight to 2 parts by weight, based on 1 equivalent of the compound represented by Formula (IV), (V-1), or (V-2).

In the coupling reaction, a base is used. Specific examples of the base to be used include sodium hydroxide, potassium hydroxide, sodium carbonate, potassium carbonate, and the like. The base may be used in an amount ranging, for example, from 0.5 equivalents to 3 equivalents, and preferably 0.7 equivalents to 2 equivalents, relative to 1 equivalent of the compound represented by Formula (IV), (V-1), or (V-2).

In the reaction, a solvent may or may not be used. When using the solvent, examples of the solvent to be used include high-boiling point water-insoluble hydrocarbon-based solvents such as n-tridecane, tetralin, p-cimene, terpinolene, and the like, high-boiling point halogen-based solvents such as o-dichlorobenzene, chlorobenzene, and the like, and others. The solvent is used in an amount ranging, for example, from 0.1 parts by weight to 3 parts by weight, and preferably 0.2 parts by weight to 2 parts by weight, relative to 1 part by weight of the compound represented by Formula (IV), (V-1), or (V-2).

Furthermore, the reaction may be carried out under an inert gas atmosphere such as nitrogen, argon, and the like, for example, at a temperature ranging from 100° C. to 300° C., preferably from 150° C. to 270° C., and further preferably from 180° C. to 230° C., while efficiently stirring, and it is preferably carried out while removing water to be produced during the reaction.

After completion of the reaction, optional cooling may be carried out, and then hydrolysis is carried out using a solvent such as methanol, ethanol, n-octanol, ethylene glycol, propylene glycol, glycerin, or the like, and a salt such as sodium hydroxide, potassium hydroxide, or the like.

The amount of the solvent to be used in hydrolysis may be, for example, 0.5 parts by weight to 10 parts by weight, and may be preferably 1 part by weight to 5 parts by weight, relative to 1 part of weight of the compound represented by Formula (IV), (V-1), or (V-2). Further, the amount of the base to be used in the hydrolysis may be, for example, 0.2 parts by weight to 5 parts by weight, and preferably 0.3 parts by weight to 3 parts by weight, relative to 1 part of weight of the compound represented by Formula (IV), (V-1), or (V-2).

Furthermore, after the coupling reaction, the solvent and the salt are added directly into the reaction solution, while stirring the solution at a temperature ranging from 50° C. to a boiling point of the solvent to be used, under an inert gas atmosphere such as nitrogen, argon, and the like, thereby performing the hydrolysis reaction.

Furthermore, in this case, the coupling reaction yields a carboxylate to cause solidification, and therefore, in order to increase the reaction temperature, for example, a solvent having a boiling point of 150° C. or higher is used as the solvent.

After completion of the hydrolysis reaction, water is poured into the reaction product, and the reaction product is neutralized with hydrochloric acid or the like, to isolate a triarylamine compound represented by Formula (VII). In the post-treatment after the hydrolysis reaction, after pouring water, for neutralizing the reaction product with hydrochloric acid or the like to isolate the triarylamine compound represented by Formula (VII), water-soluble ethylene glycol, propylene glycol, glycerin, or the like may be added.

Subsequently, after washing and optionally dissolving in a solvent, treatments such as column purification with silica gel, alumina, activated white clay, activated carbon, or the like, or addition of these adsorbents to the solution thereby adsorbing the unwanted products, and the like are carried out. Further, recrystallization may be carried out from a solvent such as acetone, ethanol, ethyl acetate, toluene, and the like, or esterification to methyl ester, ethyl ester, or the like and then the same recrystallization operation may be carried out sequentially.

Then, the triarylamine compound represented by Formula (VII) may be reacted with a formylating agent such as N,N-dimethylformamide, N-methylformanilide, and the like in the presence of phosphorous oxychloride to obtain a formylated form (VIII) of the triarylamine derivative. In this case, an excess amount of the formylating agent may be used to make the formylating agent serve as the reaction solvent, but a solvent inert to the reaction such as o-dichlorobenzene, benzene, methylene chloride, or the like may be used as the solvent. The reaction temperature may be, for example, from 0° C. to the boiling point of a solvent to be used, and preferably from 27° C. to 150° C.

Next, a cyclization reaction of a formylated form of the triarylamine derivative represented by Formula (XI) with a diaminobenzodithiol can be carried out to obtain a low-molecular weight compound of a benzobisthiazole represented by Formula (X).

In the present exemplary embodiment, a polyester represented by Formula (II-1) may be used as a compound including a structural unit represented by the following Formula (II-3).

Formula (II-3)

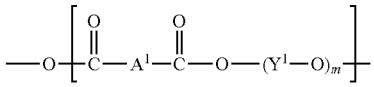

In Formula (II-3), each $Y^1$ independently represents a substituted or unsubstituted divalent hydrocarbon group, m represents an integer of from 1 to 5, and $A^1$ represents a group represented by the following Formula (II-2).

Formula (II-2)

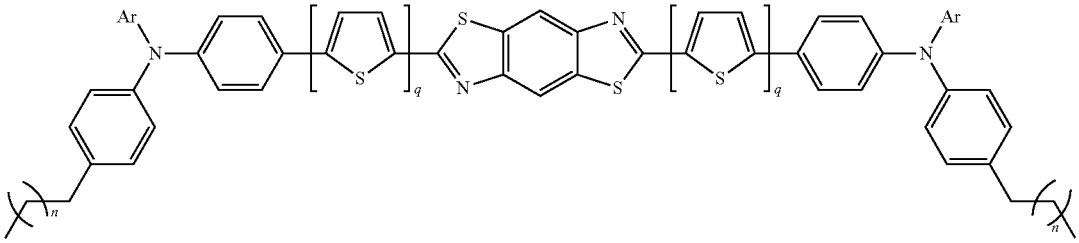

In the cyclization reaction of a formylated form of the triarylamine derivative represented by Formula (XI) with a diaminobenzodithiol, the diaminobenzodithiol is used in an amount ranging, for example, from 1.5 equivalents to 5 equivalents, and preferably from 1.7 equivalents to 4 equivalents, relative to 1 equivalent of the compound represented by Formula (XI).

In the cyclization reaction, the solvent may be optionally used. Examples of the solvent include high-boiling point water-insoluble hydrocarbon-based solvents such as n-tridecane, tetralin, p-cimene, terpinolene, and the like, high-boiling point halogen-based solvents such as o-dichlorobenzene, chlorobenzene, and the like, N,N'-dimethylformamide, dimethyl sulfoxide, and the like. The solvent is used in an amount ranging, for example, from 0.1 parts by weight to 3 parts by weight, and preferably from 0.2 parts by weight to 2 parts by weight, relative to 1 part by weight of a formylated form of the triarylamine derivative represented by Formula (XI).

The cyclization reaction is carried out under an inert gas atmosphere such as nitrogen, argon, and the like, for example, at a temperature ranging from 100° C. to 300° C., preferably from 150 to 270° C., and further preferably from 180° C. to 250° C., while efficiently stirring, and it is preferably carried out while removing water to be produced during the reaction. After completion of the reaction, the reaction product is dissolved in a solvent such as toluene, ISOPAR, n-tridecane, and the like, and unwanted products are optionally removed by water washing or filtration, and treatments such as column purification with silica gel, alumina, activated white clay, activated carbon, or the like, or addition of these adsorbents to the solution thereby adsorbing the unwanted products, and the like are carried out. Further, recrystallization is carried out from a solvent such as ethanol, ethyl acetate, toluene, and the like for purification. However, the synthesis methods in the present exemplary embodiment are not limited thereto.

<Compound Including Structural Unit Represented by Formula (II-3) (Polyester)>

Hereinbelow, a compound including the structural unit represented by the following Formula (II-3) is be described in detail.

In Formula (II-2), Ar represents a substituted or unsubstituted phenyl group, a substituted or unsubstituted, monovalent polynuclear aromatic hydrocarbon group having from 2 to 10 aromatic rings, a substituted or unsubstituted, monovalent condensed aromatic hydrocarbon group having from 2 to 10 aromatic rings, or a substituted or unsubstituted monovalent aromatic heterocyclic group, q represents 0 or 1, and each n independently represents an integer from 0 to 7.

The polyester including the structural unit represented by Formula (II-3) includes a structural unit $A^1$ derived from the benzobisthiazole compound represented by Formula (I). Further, since the polyester including the structural unit represented by Formula (II-3) is a polymer, it has higher heat resistance than charge transporting materials such as N,N'-diphenyl-N,N'-di(m-tolyl)benzidine and the like that are low-molecular weight compounds.

Accordingly, the polyester including the structural unit represented by Formula (II-3) may be suitably used in an image holding member for an image forming apparatus.

Furthermore, by allowing the polymer including the structural unit represented by Formula (II-3) to have an ester structure, it becomes easier to synthesize a polymer, to which a structural unit $A^1$ derived from the benzobisthiazole compound represented by Formula (I) has been introduced.

Hereinbelow, Formula (II-3) is described in detail.

In Formula (II-3), each $Y^1$ independently represents a substituted or unsubstituted divalent hydrocarbon group.

The divalent hydrocarbon group represented by $Y^1$ is a divalent alcohol residue, and it is preferably an alkylene group, a (poly)ethyleneoxy group, a (poly)propyleneoxy group, arylene group, a divalent heterocyclic group, or a combination thereof.

The divalent hydrocarbon group represented by $Y^1$ is preferably a linking group having a small number of carbon atoms from the viewpoints of compatibility with a resin and charge transporting property. Specifically, it is preferably one having carbon atoms ranging from 1 to 18, and more preferably from 1 to 6.

Further, the divalent hydrocarbon group represented by $Y^1$ is preferably a linking group having a small dipole moment from the viewpoints of charge transporting property. Specifically, it is preferably a linking group containing no atom other than a carbon atom and a hydrogen atom (for example, an oxygen atom, a nitrogen atom, a sulfur atom, and the like).

That is, the divalent hydrocarbon group represented by $Y^1$ is preferably an alkylene group having from 1 to 10 carbon atoms or an arylene group having from 6 to 18 carbon atoms, and more preferably an alkylene group having from 1 to 6 carbon atoms.

The divalent hydrocarbon group represented by $Y^1$ is more preferably a group having low steric bulkiness from the viewpoints of compatibility with a resin. Examples of the divalent hydrocarbon having low steric bulkiness include a group having no ring structure, and specific examples thereof include alkylene groups having from 1 to 10 carbon atoms, and preferably an alkylene group having from 1 to 5 carbon atoms. Further, from the viewpoints of easy synthesis of a polymeric compound having a high molecular weight in addition to compatibility with a resin, an alkylene group having 2 carbon atoms is still more preferable.

Specific examples of $Y^1$ in Formula (II-3) include groups selected from formulae (1) to (7) below.

(1) $-(CH_2)_d-$ (2) $-(CH_2CH_2O)_e-(CH_2CH_2)-$ (3)

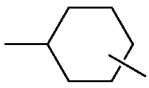

(4)

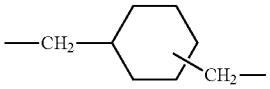

(5)

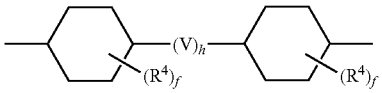

(6)

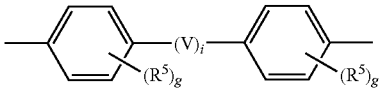

(7)

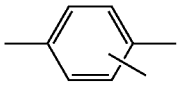

In formulae (1) and (2), d and e each independently represent an integer of from 1 to 10.

In formulae (5) and (6), $R^4$ and $R^5$ each independently represent an alkyl group having from 1 to 4 carbon atoms, an akoxyl group having from 1 to 4 carbon atoms, a substituted or unsubstituted phenyl group, a substituted or unsubstituted aralkyl group, or a halogen atom.

In formulae (5) and (6), f and g represent an integer of 0, 1, or 2, respectively, h and i represent 0 or 1, respectively, and V represents a group selected from the following formulae (8) to (28).

(8) $-(CH_2)_b-$ (9) $-C(CH_3)_2-$

(10) $-O-$

-continued

(11) $-S-$

(12) $-C(CF_3)_2-$

(13) $-Si(CH_3)_2-$ (14)

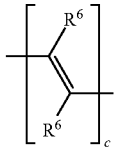

(15)

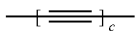

(16)

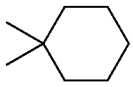

(17)

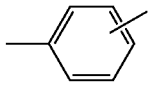

(18)

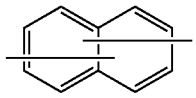

(19)

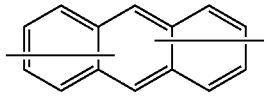

(20)

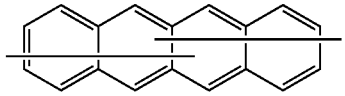

(21)

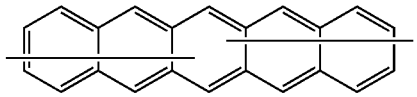

(22)

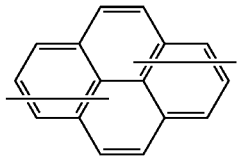

(23)

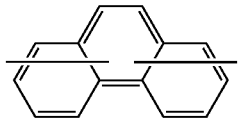

(24)

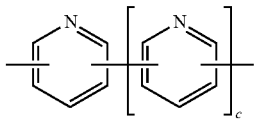

(25)

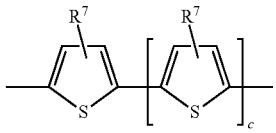

-continued (26)

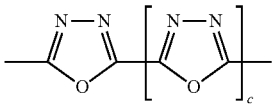

(27)

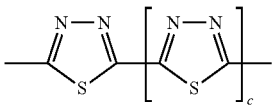

(28)

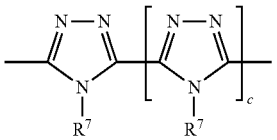

In formula (8), b represents an integer of from 1 to 10, preferably an integer of from 1 to 6, and more preferably an integer of from 1 to 4.

In formula (14), each $R^6$ independently represents a hydrogen atom, an alkyl group, or a cyano group.

In formulae (25) and (28), each $R^7$ independently represents a hydrogen atom, an alkyl group having from 1 to 10 carbon atoms, an alkoxyl group having from 1 to 10 carbon atoms, a substituted or unsubstituted phenyl group, a substituted or unsubstituted aralkyl group, or a halogen atom.

In formulae (14), (15), and (24) to (28), each c independently represents an integer of from 0 to 10, preferably an integer of from 0 to 6, and more preferably an integer of from 1 to 3.

Plural $Y^1$'s in the compound including the structural unit represented by Formula (II-3) may be the same as or different from each other, but they are preferably the same as each other from the viewpoints of preparation.

In Formula (II-3), m represents an integer or from 1 to 5. From the viewpoints of compatibility of solubility and accomplishment of high molecular weights, m is preferably an integer of from 1 to 3, and from the viewpoints of accomplishment of high molecular weights, m is more preferably an integer of from 1 to 2. Further, from the viewpoints of improving the electrical characteristics of the image holding member for an image forming apparatus, m in Formula (II-3) is more preferably 1.

In Formula (II-3), $A^1$ represents a group represented by the following Formula (II-2).

Ar, q, and n in Formula (II-2) have the same definitions as Ar, q, and n in Formula (I), respectively, and also have the same preferable definitions as Ar, q, and n in Formula (I), respectively. Further, when q in the polyester including the structural unit represented by Formula (II-3) is 1, it may be particularly hard to be dissolved in a solvent and thus, an q is preferably 0 from the viewpoints of the solubility.

Plural A1's in the compound including the structural unit represented by Formula (II-3) may be all the same as each other, or two or more kinds thereof may be included.

Examples of the polyester including the structural unit represented by Formula (II-3) include a polyester represented by the following Formula (II-1) and a polyester represented by the following Formula (II-4), and the like. Since all of these contain a structural unit $A^1$ derived from the Formula (I) (that is, the group represented by Formula (II-2)), they have good charge transporting property and their stabilities, and they are suitable for an image holding member for an image forming apparatus.

Further, the polyester represented by the following Formula (II-1) has $A^1$ which is a carboxylic acid residue, and the polyester represented by the following Formula (II-4) has $A^1$ and $Z^1$ each of which is a carboxylic acid residue. Accordingly, the polyester represented by the following Formula (II-1) is excellent from the viewpoints of ease of synthesis, and the polyester represented by the following Formula (II-4) may become more suitable for an image holding member for an image forming apparatus depending on the carboxylic acid residue $Z^1$ to be combined therewith.

Formula (II-1)

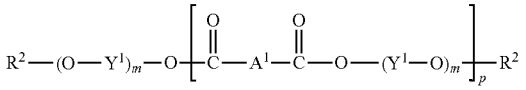

In Formula (II-1), each $Y^1$ independently represents a substituted or unsubstituted divalent hydrocarbon group, $A^1$ represents a group represented by Formula (II-2), and each $R^2$ independently represents a substituted or unsubstituted, monovalent polynuclear aromatic hydrocarbon group having from 2 to 10 aromatic rings, a substituted or unsubstituted, monovalent condensed aromatic hydrocarbon group having from 2 to 10 aromatic rings, a substituted or unsubstituted, Formula (II-2)

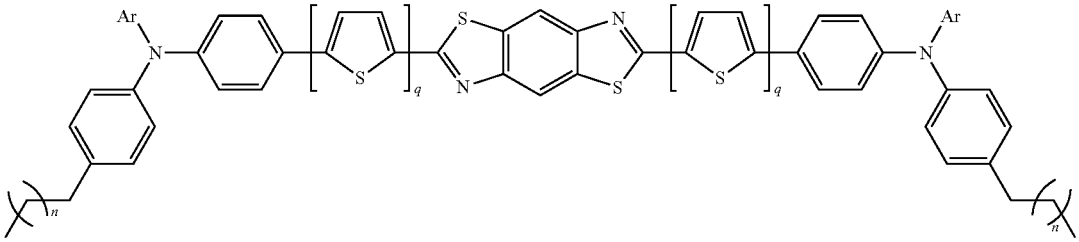

In Formula (II-2), Ar represents a substituted or unsubstituted phenyl group, a substituted or unsubstituted, monovalent polynuclear aromatic hydrocarbon group having from 2 to 10 aromatic rings, a substituted or unsubstituted, monovalent condensed aromatic hydrocarbon group having from 2 to 10 aromatic rings, or a substituted or unsubstituted monovalent aromatic heterocyclic group, q represents 0 or 1, and each n independently represents 0 to 7.

monovalent linear hydrocarbon group having 1 to 6 carbon atoms, a substituted or unsubstituted, monovalent branched hydrocarbon group having from 2 to 10 carbon atoms, or a hydrogen atom. Each m independently represents an integer of from 1 to 5, and p represents an integer of from 5 to 5,000.

That is, in Formula (II-1), $Y^1$, $A^1$, and m have the same definitions as $Y^1$, $A^1$, and m in Formula (II-3), respectively.

Formula (II-4)

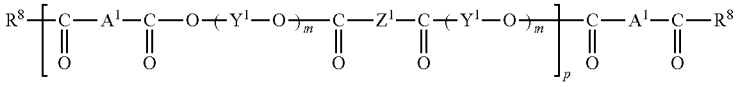

In Formula (II-4), $Y^1$, $A^1$, m, and p have the same definitions as $Y^1$, $A^1$, m, and p in Formula (II-1), respectively. Each $R^8$ independently represents a group —O—($Y^1$—O)$_m$—H or —O—($Y^1$—O)$_m$—CO—$Z^1$—CO—$OR^2$. Herein, $R^2$ has the same definitions as $R^2$ in Formula (II-1). $Z^1$ represents a divalent hydrocarbon group (that is, a carboxylic acid residue).

In Formulae (II-1) and (II-4), p represents an integer of from 5 to 5,000. In consideration of the solubility in an ordinary solvent when used in a coating film composition (coating liquid), p is preferably an integer of from 5 to 2,000, it is more preferably an integer of from 5 to 600 from the viewpoints of easy synthesis, and it is further preferably an integer of from 5 to 500 from the viewpoints of molecular dispersibility Mw/Mn.

Further, when p is in the range from 5 to 5,000, the ionization potentials are scarcely affected by the number of p, and it is presumed that when p is in this range, the maximum ion potential variation is likely to be within around 0.1 eV.

In Formula (II-1), Each $R^2$ independently represent a substituted or unsubstituted, monovalent polynuclear aromatic hydrocarbon group having from 2 to 10 aromatic rings, a substituted or unsubstituted, monovalent condensed aromatic hydrocarbon group having from 2 to 10 aromatic rings, a substituted or unsubstituted, monovalent linear hydrocarbon group having from 1 to 6 carbon atoms, a substituted or unsubstituted, monovalent branched hydrocarbon group having from 2 to 10 carbon atoms, or a hydrogen atom. $R^2$ included in the group represented by $R^8$ in Formula (II-4) has the same definitions as $R^2$ in Formula (II-1).

Among those, $R^2$ is preferably a hydrogen atom or a phenyl group, and from the viewpoints of low cost and easy preparation, it is more preferably a hydrogen atom.

Two $R^2$'s in Formulae (II-1) and (II-4) may be the same as or different from each other, but from the viewpoints of preparation, they are preferably the same as each other. Two $R^8$'s in Formula (II-4) may also be the same as or different from each other, but from the viewpoints of preparation, they are preferably the same as each other.

$Z^1$ in Formula (II-4) represents a divalent carboxylic acid residue.

Specifically, it has the same definition as a divalent linking group exemplified as $Y^1$ in Formula (II-3), and also has the same preferable definition as well. Plural $Z^1$'s in Formula (II-4) may be the same as or different from each other, but from the viewpoints of preparation, they are preferably the same as each other.

Plural $A^1$'s in Formula (II-1) and Formula (II-4) may be the same as or different from each other, but from the viewpoints of preparation, they are preferably the same as each other.

Further, plural m's in Formula (II-1) and Formula (II-4) may be the same as or different from each other, but from the viewpoints of preparation, they are preferably the same as each other.

A polyester including a structural unit derived from the compound represented by Formula (II-1), Formula (II-4), or the like, and Formula (I) preferably has a weight average molecular weight Mw in the range from 5,000 to 300,000, and generally, in consideration of the solubility in a solvent when used in a coating liquid, the weight average molecular weight is preferably from 10,000 to 200,000, and more preferably from 30,000 to 150,000.

Further, the weight average molecular weight is an average molecular weight in terms of a polystyrene, measured by means of gel permeation chromatography (carrier: tetrahydrofuran).

Specific Exemplary Polymers 1 to 32 of the polyester represented by Formula (II-1) (that is, Specific Exemplary Polyester 1 to 32) are shown below, but the present exemplary embodiments are not limited to these specific examples.

Further, the number in the section of the monomer in Specific Exemplary Polymer (section of the "structural number of $A^1$") corresponds to the number of Specific Exemplary Compound (Specific Exemplary Compound No.), which is a compound represented by Formula (I). Hereinbelow, a specific example (compound) attached with a number, for example, the structure of $A^1$ attached with the number of 15 means a structure derived from Specific Exemplary Compound 15.

Furthermore, $Y^1$, m, p, and $R^2$ in Specific Exemplary Polymer represent $Y^1$, m, p, and $R^2$ in Formula (II-1) respectively.

| Specific Exemplary Polymer No. | Structural No. of $A^1$ | $Y^1$ | m | $R^2$ | p |
|---|---|---|---|---|---|
| 1 | 1 | —(CH$_2$)$_2$— | 1 | H | 65 |
| 2 | 1 | —(CH$_2$)$_6$— | 1 | H | 75 |
| 3 | 1 | 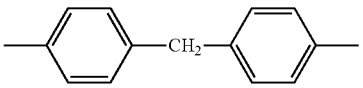 | 1 | H | 45 |
| 4 | 1 | 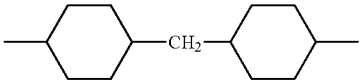 | 1 | H | 38 |

-continued
| Specific Exemplary Polymer No. | Structural No. of $A^1$ | $Y^1$ | m | $R^2$ | p |
|---|---|---|---|---|---|
| 5 | 1 | 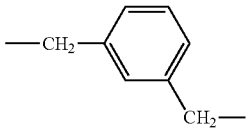 | 1 | H | 49 |
| 6 | 4 | $-(CH_2)_2-$ | 1 | H | 81 |
| 7 | 4 | 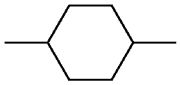 | 1 | H | 61 |
| 8 | 4 | 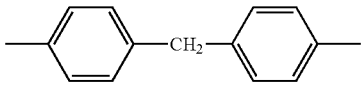 | 1 | H | 59 |
| 9 | 4 | 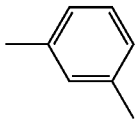 | 1 | H | 87 |
| 10 | 5 | $-(CH_2)_2-$ | 1 | H | 80 |
| 11 | 6 | $-(CH_2)_6-$ | 1 | H | 74 |
| 12 | 8 | $-(CH_2)_2-$ | 1 | H | 67 |
| 13 | 9 | 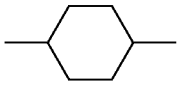 | 1 | H | 41 |
| 14 | 10 | $-(CH_2)_6-$ | 1 | H | 49 |
| 15 | 12 | $-(CH_2)_2-$ | 1 | H | 52 |
| 16 | 14 | $-(CH_2)_2-$ | 1 | H | 55 |
| 17 | 14 | 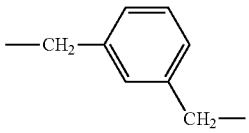 | 1 | H | 62 |
| 18 | 15 | $-(CH_2)_2-$ | 1 | H | 49 |
| 19 | 15 | 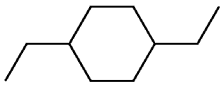 | 1 | H | 54 |
| 20 | 19 | $-(CH_2)_6-$ | 1 | H | 57 |
| 21 | 23 | $-(CH_2)_2-$ | 1 | H | 83 |

-continued

| Specific Exemplary Polymer No. | Structural No. of $A^1$ | $Y^1$ | m | $R^2$ | p |
|---|---|---|---|---|---|
| 22 | 23 | 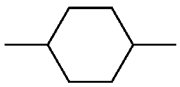 | 1 | H | 82 |
| 23 | 24 | 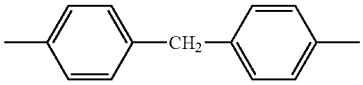 | 1 | H | 31 |
| 24 | 25 | $-(CH_2)_2-$ | 1 | H | 61 |
| 25 | 26 | $-(CH_2)_2-$ | 1 | H | 78 |
| 26 | 30 | $-(CH_2)_2-$ | 1 | H | 75 |
| 27 | 32 | $-(CH_2)_2-$ | 1 | H | 64 |
| 28 | 32 | $-(CH_2)_6-$ | 1 | H | 57 |
| 29 | 33 | $-(CH_2)_2-$ | 1 | H | 62 |
| 30 | 35 | 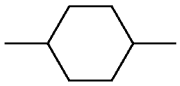 | 1 | H | 43 |
| 31 | 37 | $-(CH_2)_2-$ | 1 | H | 58 |
| 32 | 38 | $-(CH_2)_2-$ | 1 | H | 61 |

A method for synthesizing a polyester including the structural unit represented by Formula (II-1) may be a method in which known methods are combined according to the desired structures. The synthesis method is not particularly limited. An example of a method for synthesizing a benzobisthiazole-containing polyester which may used in the image holding member for an image forming apparatus of the present exemplary embodiment is described below.

The polyester represented by Formula (II-1) can be obtained by polymerization of a monomers represented by the following Formula (I-3) using a known method as described in, for example, Fourth Edition of Courses of Experiment Chemistry Vol. 28 (Maruzen Co., Ltd.), 1992) and the like.

$$A^1\text{-}A^2\text{-}A^3 \qquad \text{Formula (I-3)}$$

In Formula (I-3), $A^1$ represents a partial structure derived from at least one compound represented by Formula (I), and has the same definition as $A^1$ in Formula (II-1). $A^2$ represents a hydroxyl group, a halogen atom, or —O—$R^9$, in which $R^9$ represents an alkyl group, a substituted or unsubstituted aryl group, or an aralkyl group.

That is, the polyester represented by Formula (II-1) is synthesized by the following manner.

1) When $A^2$ is Hydroxyl Group

A divalent alcohol represented by HO—($Y^1$—O)$_m$—H in an equivalent amount is mixed with the compound represented by Formula (I-3), and the mixture are subjected to polymerization using an acid catalyst. $Y^1$ represents a divalent alcohol residue and has the same definition as $Y^1$ in Formula (II-1). m represents an integer of from 1 to 5 and has the same definition as m in Formula (II-1).

As the acid catalyst, one which is used for an ordinary esterification reaction, such as sulfuric acid, toluene sulfonic acid, trifluoroacetic acid, and the like is used, and is used in an amount ranging from 1/10,000 parts by weight to 1/10 parts by weight, and preferably from 1/1,000 parts by weight to 1/50 parts by weight, based on 1 part by weight of the monomer (that is, the compound represented by Formula (I-3)).

In order to remove water produced during the polymerization, a solvent which is azeotroped with water is preferably used, and toluene, chlorobenzene, 1-chloronaphthalene, or the like is effective. The solvent may be used in an amount ranging from 1 part by weight to 100 parts by weight, and preferably from 2 parts by weight to 50 parts by weight, based on 1 part by weight of the monomer.

The reaction temperature is determined according to the conditions, but in order to remove water produced during the polymerization, the reaction is preferably performed at the boiling point of the solvent.

After completion of the reaction, when a solvent is not used in the reaction, the resultant is dissolved in a solvent for dissolution. When a solvent is used in the reaction, the reaction solution is used as it is. The solution is added dropwise to a poor solvent in which polymers are barely dissolved, such as alcohols (for example, methanol, ethanol, or the like), acetone or the like, and the polyester is precipitated. After separating out the polyester, the polyester is sufficiently washed with water or an organic solvent, and dried.

Furthermore, the obtained product may be optionally repeatedly subjected to a reprecipitation treatment in which the obtained product is dissolved in a suitable organic solvent, the obtained solution is added dropwise to a poor solvent, and the polyester is precipitated. During the reprecipitation treatment, it is preferable to carry out the treatment while efficiently stirring with a mechanical stirrer or the like. The solvent to dissolve the polyester during the reprecipitation treatment may be used in an amount ranging from 1 part by weight to 100 parts by weight, and preferably from 2 parts by weight to 50 parts by weight, based on 1 part by weight of the polyester. Further, the poor solvent may be used in an amount ranging from 1 part by weight to 1,000 parts by weight, and preferably from 10 parts by weight to 500 parts by weight, based on 1 part by weight of the polyester.

2) When $A^2$ is Halogen

A divalent alcohol represented by $HO—(Y^1—O)_m—H$ in an equivalent amount is mixed with a compound represented by Formula (I-3), and the mixture is subjected to a polymerization reaction using an organic basic catalyst such as pyridine, triethylamine, and the like. $Y^1$ represents a divalent alcohol residue and has the same definition as $Y^1$ in the Formula (II-1). m represents an integer of from 1 to 5 and has the same definition as m in Formula (II-1).

The organic basic catalyst may be used in an amount ranging from 1 equivalent to 10 equivalents, and preferably from 2 equivalents to 5 equivalents, based on 1 equivalent of the monomer.

As the solvent, methylene chloride, tetrahydrofuran (THF), toluene, chlorobenzene, 1-chloronaphthalene, or the like is effective, and the amount thereof may be ranging from 1 part by weight to 100 parts by weight, preferably from 2 parts by weight to 50 parts by weight, based on 1 part by weight of the monomer.

The reaction temperature is determined according to the condition. After the polymerization, reprecipitation is carried out as described above to purify the obtained product.

Furthermore, in a case in which a divalent alcohol having high acidity, such as bisphenol and the like is used, an interfacial polymerization method may be used. That is, the divalent alcohol is added to water, an equivalent amount of a base is added thereto, and then a monomer solution in an equivalent amount to the divalent alcohol is added while stirring vigorously to perform polymerization. At this time, water may be used in an amount ranging from 1 part by weight to 1,000 parts by weight, and preferably from 2 parts by weight to 500 parts by weight, based on 1 part by weight of the divalent alcohol. As the solvent in which the monomer is dissolved, methylene chloride, dichloroethane, trichloroethane, toluene, chlorobenzene, 1-chloronaphthalene, or the like is effective.

The reaction temperature is determined according to the condition, and in order to promote the reaction, it is effective to use a phase transfer catalyst such as an ammonium salt, a sulfonium salt, and the like. The phase transfer catalyst may be used in an amount ranging from 01 parts by weight to 10 parts by weight, and preferably from 0.2 parts by weight to 5 parts by weight, based on 1 part by weight of the monomer.

3) When $A^2$ is $—O—R^9$

A divalent alcohol represented by $HO—(Y^1—O)_m—H$ in an excess amount is added to the compound represented by Formula (I-3), and an inorganic acid such as sulfuric acid, phosphoric acid, or the like, an acetate or carbonate of titanium alkoxide, calcium, cobalt, or the like, or oxide of zinc or lead is used as a catalyst. The mixture is heated and the synthesis is performed by transesterification. $Y^1$ represents a divalent alcohol residue and has the same definition as $Y^1$ in Formula (II-1). m represents an integer of from 1 to 5 and has the same definition as m in Formula (II-1).

The divalent alcohol may be used in an amount ranging from 2 equivalents to 100 equivalents, and preferably from 3 equivalents to 50 equivalents, based on 1 equivalent of the monomer (the compound represented by Formula (I-3)).

The catalyst may be used in an amount ranging from 1/10,000 parts by weight to 1 part by weight, and preferably from 1/1,000 parts by weight to 1/2 parts by weight, based on 1 part by weight of the monomer.

The reaction is carried out at a reaction temperature from 200° C. to 300° C. After completion of the transesterification from $—O—R^9$ to $—O—(Y^1—O)_m—H$, in order to promoting polymerization due to elimination of $HO—(Y^1—O)_m—H$, it is preferable to carry out the reaction under reduced pressure. Further, a high-boiling point solvent which can be azeotroped with $HO—(Y^1—O)_m—H$, such as 1-chloronaphthalene or the like may be used to carry out the reaction while removing $HO—(Y^1—O)_m—H$ azeotropically at an ambient pressure.

Furthermore, the polyester may be synthesized by the following manner.

In each of the above cases, a compound represented by the following Formula (I-4) is produced by adding the divalent alcohol in an excess amount for the reaction, and then this compound is used instead of the monomer represented by Formula (I-3) to be reacted with a divalent carboxylic acid, a divalent carboxylic acid halide, or the like, whereby a polyester represented by Formula (II-1) can be obtained.

(I-4)

$$H—(O—Y^1)_m—O—\underset{\underset{O}{\|}}{C}—A^1—\underset{\underset{O}{\|}}{C}—O—(Y^1—O)_m—H$$

In Formula (I-4), $A^1$ represents a partial structure derived from at least one selected from the compounds represented by Formula (I) and has the same definition as $A^1$ in Formula (II-1). $Y^1$ represents a divalent alcohol residue and has the same definition as $Y^1$ in Formula (II-1). m represents an integer of from 1 to 5 and has the same definition as m in Formula (II-1).

Furthermore, a molecule may be introduced into a terminal of the polyester. In this case, the following methods may be used. That is, when $A^2$ is a hydroxyl group, a copolymerization reaction is carried out in which a monocarboxylic acid which is a compound to be used for introducing the molecule at a terminal of the polymer is used. Alternatively, after the polymerization reaction to obtain a polymer, a monocarboxylic acid which is a compound to be used for introducing the molecule at the terminal is added to the obtained electron transporting compound, and the mixture is allowed to react, thereby introducing the molecule.

When $A^2$ is halogen, a copolymerization reaction is carried out in which a monoacid chloride which is a compound used for introducing the molecule at a terminal is used. Alternatively, after the polymerization reaction to obtain a polymer, a monoacid chloride which is a compound to be used for introducing the molecular at a terminal is added to the obtained polymer, and the mixture is allowed to react, thereby introducing the molecule.

When $A^2$ is $—O—R^9$, a copolymerization reaction is carried out in which a monoester which is a compound to be used for introducing the molecule at the terminal. Alternatively, after the polymerization reaction to obtain a polymer, a monoester which is a compound to be used for introducing the molecule at the terminal is added to the obtained polymer, and the mixture is allowed to react, thereby introducing the molecule.

<Image Holding Member for Image Forming Apparatus>

Hereinbelow, the structure of the image holding member for an image forming apparatus of the present exemplary embodiment is described.

The image holding member for an image forming apparatus of the present exemplary embodiment includes a support and a photosensitive layer on or above the support, wherein the photosensitive layer includes a compound including a partial structure represented by Formula (A). The compound including a partial structure represented by Formula (A) may be, for example, a compound represented by Formula (I) or a compound represented by Formula (II-1). In the image holding member for an image forming apparatus, the photosensitive layer may includes at least one compound selected from a group consisting of a compound represented by Formula (I) and a compound represented by Formula (II-1).

Figure 2:
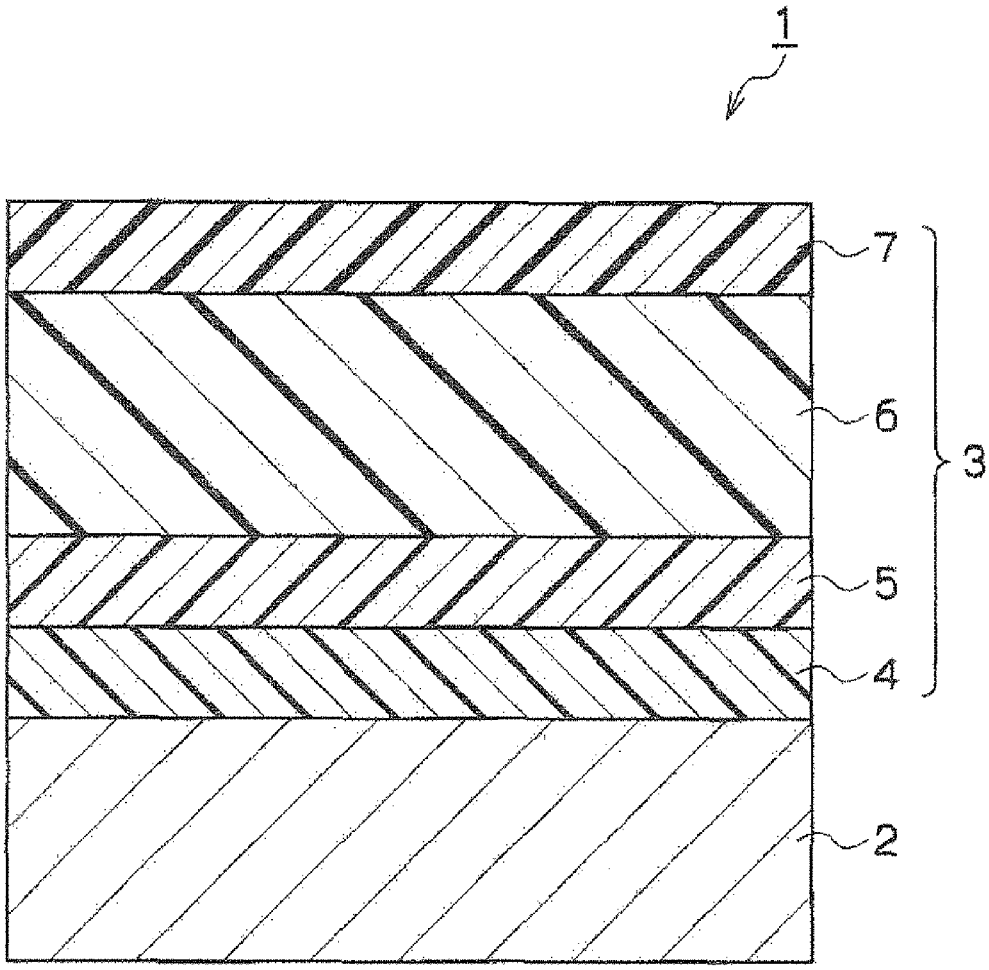
FIG. 2 is a schematic cross-sectional view of an image holding member for an image forming apparatus according to an exemplary embodiment.
Figure 3:
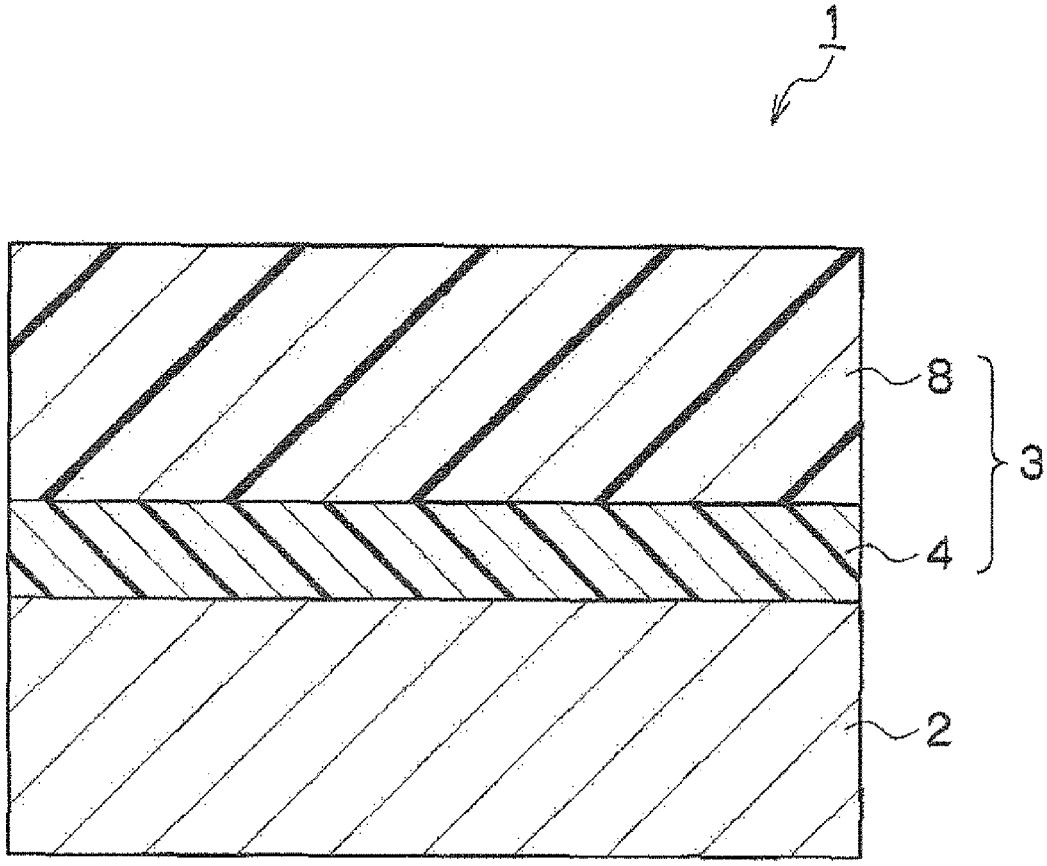
FIG. 3 is a schematic cross-sectional view of an image holding member for an image forming apparatus according to an exemplary embodiment.

FIGS. 1 to 3 are a schematic cross-sectional view showing, respectively, the first to third exemplary embodiments of the image holding member for an image forming apparatus of the present exemplary embodiment.

FIGS. 1 to 3 each are views obtained by cutting the image holding member for an image forming apparatus 1 along the direction for disposing a conductive support 2 and a photosensitive layer 3.

The image holding member for an image forming apparatus 1 according to the first and second exemplary embodiments shown respectively in FIGS. 1 and 2 includes a functional separation type photosensitive layer, in which a charge generating material and a charge transporting material are contained in the different layers. That is, in the photosensitive layer 3, a layer containing the charge generating material layer (charge generating layer 5) and a layer containing the charge transporting material (charge transporting layer 6) are separately formed, and are disposed so as to be adjacent to each other.

On the other hand, the image holding member for an image forming apparatus 1 according to the third exemplary embodiment shown in FIG. 3 includes a single-layer type photosensitive layer, in which the charge generating material and the charge transporting material are contained in the same layer. That is, in the photosensitive layer 3, a single layer of a charge generating/transporting layer 8 containing the charge generating material and the charge transporting material is formed.

More specifically, in the image holding member for an image forming apparatus 1 according to the first exemplary embodiment, the photosensitive layer 3 is configured to have an undercoat layer 4, a charge generating layer 5, and a charge transporting layer 6 disposed in this order from the conductive support 2, on the conductive support 2, and in the image holding member for an image forming apparatus 1 according to the second exemplary embodiment, the photosensitive layer 3 is configured to have the undercoat layer 4, the charge generating layer 5, the charge transporting layer 6, and the protective layer 7 disposed in this order from the conductive support 2, on the conductive support 2. In the image holding member for an image forming apparatus 1 according to the third exemplary embodiment, the photosensitive layer 3 is configured to have the undercoat layer 4 and the charge generating/transporting layer 8 disposed in this order from the conductive support 2, on the conductive support 2.

Further, although not shown in the figure, in an exemplary embodiment the order for disposing the charge generating layer 5 and the charge transporting layer 6 in the second exemplary embodiment may be reversed (which is as a modified form of the second exemplary embodiment). In an exemplary embodiment, the protective layer 7 used in the second exemplary embodiment is formed on the charge generating/transporting layer 8 of the third exemplary embodiment (which is a modified form of the third exemplary embodiment).

As the conductive support 2, aluminum can be used in any shape such as a drum shape, a sheet shape, a plate shape, or any other shape, but not limited thereto. The conductive support 2 may be subjected to an anodizing treatment, a boehmite treatment, a honing treatment, or the like.

An undercoat layer 4 as shown in FIGS. 1 to 3 is provided in a region between the conductive support 2 and the photosensitive layer 3 or a region between the conductive support 2 and the charge generating/transporting layer 8. In the undercoat layer 4, any of organic zirconium compounds such as a zirconium chelate compound, a zirconium alkoxide compound, a zirconium coupling agent, and the like; organic titanium compounds such as a titanium chelate compound, a titanium alkoxide compound, a titanate coupling agent, and the like; organic aluminum compounds such as an aluminum chelate compound, an aluminum coupling agent, and the like; or organic metal compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, an aluminum zirconium alkoxide compound, and the like may be used. In particular, any of organic zirconium compounds, organic titanium compounds, or organic aluminum compounds may be preferably used.

The undercoat layer 4 may further include a silane coupling agent. Examples of the silan coupling agent include vinyl trichlorosilane, vinyl trimethoxysilane, vinyl triethoxysilane, vinyl tris-2-methoxyethoxysilane, vinyl triacetoxysilane, γ-glycidoxypropyl trimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyl trimethoxysilane, γ-ureiodpropyl triethoxysilane, β-3,4-epoxycyclohexyltrimethoxysilane, and the like.

The undercoat layer may include a known binder resin. Examples thereof include a polyvinyl alcohol, a polyvinyl methyl ether, a poly-N-vinylimidazole, a polyethylene oxide, an ethyl cellulose, a methyl cellulose, an ethylene-acrylic acid copolymer, a polyamide, a polyimide, casein, gelatin, polyethylene, a polyester, a phenol resin, a vinyl chloride-vinyl acetate copolymer, an epoxy resin, a polyvinyl pyrrolidone, polyvinyl pyridine, polyurethane, polyglutamic acid, polyacrylic acid, and the like. The mixing ratio thereof may be determined as appropriate.

Furthermore, an electron transporting pigment may be mixed or dispersed in the undercoat layer 4.

Examples of the electron transporting pigment include organic pigments such as a perylene pigment described in JP-A No. 47-30330, a bisbenzimidazole perylene pigment, a polycyclic quinone pigment, an indigo pigment, a quinacridone pigment, and the like, and examples of the electron transporting pigment further include organic pigments such as a bisazo pigment and phthalocyanine pigment having an electron attractant substituent group such as a cyano group, a nitro group, a nitroso group, a halogen atom, and the like; and inorganic pigments such as zinc oxide, titanium oxide, and the like. Among these pigments, a perylene pigment, a bisbenzimidazole perylene pigment, a polycyclic quinone pigment, zinc oxide, titanium oxide, and the like are preferable.

Further, the surfaces of these pigments may be treated with the above-mentioned coupling agent, a binder, or the like. The electron transporting pigment may be used at a content of 95 wt % or less, and preferably 90 wt % or less based on the total amount of the undercoat layer 4.

As the method of mixing or dispersing the electron transporting pigment in the undercoat layer 4, an ordinary method using a ball mill, a roll mill, a sand mill, an attritor, ultrasonic waves, or the like is used. The mixing and dispersing are carried out in an organic solvent, but the organic solvent may be any organic solvent, as long as the organic solvent dissolves an organic metallic compound and a resin, and do not cause gelation or aggregation during mixing or dispersion of the electron transporting pigment.

The undercoat layer 4 preferably has a thickness ranging from 0.1 μm to 30 μm, and more preferably from 0.2 μm to 25 μm.

Furthermore, as a coating method for providing the undercoat layer 4, an ordinary method such as a blade coating method, a Meyer bar coating method, a spray coating method, a dip coating method, a bead coating method, an air knife coating method, a curtain coating method, and the like is used.

The coated film formed by coating the composition for forming an undercoat layer containing the components above is dried to obtain the undercoat layer 4, but the drying is generally carried out at such a temperature that the solvent may be evaporated to form a film. In particular, a substrate that has been subjected to an acidic solution treatment or a boemite treatment tends to have its defects insufficiently hidden, and thus, it is preferable to form the undercoat layer 4 when using such a substrate.

As the charge generating material contained in the charge generating layer 5, a known pigment, for example, an azo pigment such bisazo, trisazo, or the like; or a condensed-ring aromatic pigment such as dibromoanthanthrone; a perylene pigment, a pyrrolopyrrole pigment, a phthalocyanine pigment, or the like can be used, and metallic and non-metallic phthalocyanine pigments are more preferred. Among these, hydroxygallium phthalocyanine disclosed in JP-A No. 5-263007 and JP-A No. 5-279591, chlorogallium phthalocyanine disclosed in JP-A No. 5-98181, dichlorotin phthalocyanine disclosed in JP-A No. 5-140472 and JP-A No. 5-140473, and titanyl phthalocyanine disclosed in JP-A No. 4-189873 and JP-A No. 5-43813 are further preferred.

The charge generating layer 5 is formed by mixing the charge generating material with a binder resin, and the binder resin may be selected from a wide range of insulating resins. The binder resin may also be selected from an organic photoconductive polymer such as poly-N-vinylcarbazole, polyvinylanthracene, polyvinylpyrene, polysilane, and the like. Preferred examples of the binder resin include an insulating resin such as a polyvinyl butyral resin, a polyarylate resin (a polycondensate of bisphenol A and phthalic acid, and the like), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, an urethane resin, an epoxy resin, casein, a polyvinyl alcohol resin, a polyvinylpyrrolidone resin, and the like, but the binder resin used in the charge generating layer 5 is not limited thereto. One kind of the binder resin may be used or two or more kinds of the binder resin may be used in combination.

The insulating resin in the present invention refers to an insulating resin having a volume resistivity of $10^{12}$ Ω·cm or more, as measured in accordance with JIS K 7194 "Testing method for resistivity of conductive plastics with a four-point probe array".

The blending ratio (weight ratio) of the charge generating material and the binder resin is preferably in the range of from 10:1 to 1:10, and more preferably from 8:3 to 3:8.

As a method for dispersing them, an ordinary method such as a ball mill dispersing method, an attritor dispersing method, a sand mill dispersing method, or the like is used. Herein, such conditions are necessary that the crystal form of the charge generating material is not changed by dispersing. It has been confirmed that the crystal form is not changed before and after the aforementioned dispersing methods carried out in the present invention.

Further, the dispersion may be performed so as to attain the size of the particles of the charge generating material of 0.5 μm or less, preferably 0.3 μm or less, and more preferably 0.15 μm or less.

The charge generating layer 5 preferably has a thickness ranging from 0.1 μm to 5 μm, and more preferably from 0.2 μm to 2.0 μm. As a coating method used in providing the charge generating layer 5, an ordinary method such as a blade coating method, a Meyer bar coating method, a spray coating method, a dip coating method, a bead coating method, an air knife coating method, a curtain coating method, or the like is used.

As the charge transporting layer 6, a charge transporting layer formed by a known technique may be used, provided that the charge transporting layer includes a compound including a partial structure represented by Formula (A).

The charge transporting layer 6 contains a compound including a partial structure represented by Formula (A). The charge transporting layer 6 may further contains an additional charge transporting material other than the compounds including a partial structure represented by Formula (A), a binder resin, and/or the like. Further, when the compound represented by Formula (I) is used but the compound represented by Formula (II-1) is not used, it is preferable to use the compound represented by Formula (I) dissolved in a binder resin or the like. When the compound represented by Formula (II-1) is used, the charge transporting layer 6 may be formed even without the use of additional resin(s), but use in combination with additional resin(s) is preferred from the viewpoints of low cost.

Examples of the additional charge transporting materials include electron transporting compounds, for example, quinone-based compounds such as p-benzoquinone, chloranil, bromanil, anthraquinone, and the like; tetracyanoquinodimethane-based compounds, fluorenone-based compounds such as 2,4,7-trinitrofluorenone and the like, xanthone-based compounds, benzophenone-based compounds, cyanovinyl-based compounds, ethylene-based compounds, and the like. Examples of the additional charge transporting material further include hole transporting compounds, for example, triarylamine-based compounds, benzidine-based compounds, arylalkane-based compounds, aryl-substituted ethylene-based compounds, stilbene-based compounds, anthracene-based compound, hydrazone-based compounds, and the like. However, the additional charge transporting materials are not limited thereto.

The content of the compound including a partial structure represented by Formula (A) in the total amount of the charge transporting layer 6 is preferably from 5% by weight to 70% by weight, more preferably from 10% by weight to 60% by weight, and further preferably from 20% by weight to 50% by weight.

When two or more compounds each including a partial structure represented by Formula (A) are used, the total content of the two or more compounds each including a partial structure represented by Formula (A) is in the total amount of the charge transporting layer 6 is preferably from 5% by weight to 70% by weight, more preferably from 10% by weight to 60% by weight, and further preferably from 20% by weight to 50% by weight.

Further, when one or more compounds other than the compound including a partial structure represented by Formula (A) are used together with the compound as the charge transporting materials, the content of the compound(s) including a partial structure represented by Formula (A) in the total amount of the charge transporting materials is preferably 1% by weight or more, and more preferably from 5% by weight or more.

When one or more compounds other than the compound represented by Formula (A) are used together with two or more compounds each including a partial structure represented by Formula (A) as the charge transporting materials, the total content of the two or more compounds each including a partial structure represented by Formula (A) in the total amount of the charge transporting materials is preferably 1% by weight or more, and more preferably from 5% by weight or more.

When the binder resin is used in the charge transporting layer 6, examples of the binder resin include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, and a styrene-alkyd resin, and polymer charge transporting materials such as poly-N-vinylcarbazole, polysilane, and polyester polymer charge transporting materials disclosed in JP-A No. 8-176293 and JP-A No. 8-208820, and the like. One kind of these binder resins may be used singly or two or more kinds thereof may be used in combination. The blending ratio (weight ratio) of the charge transporting material and the binder resin is preferably from 10:1 to 1:10, and more preferably from 8:3 to 3:8.

The charge transporting layer 6 preferably has a thickness ranging from 5 μm to 50 μm, and more preferably from 10 μm to 30 μm.

As a coating method, an ordinary method such as a blade coating method, a wire bar coating method, a spray coating method, a dip coating method, a bead coating method, an air knife coating method, a curtain coating method, and the like is used.

Furthermore, one or more additives, such as an antioxidant, a light stabilizer, a thermal stabilizer, and the like, may be added to the photosensitive layer.

In addition, at least one kind of electron accepting material may be included.

The image holding member for an image forming apparatus of the present exemplary embodiment may include a protective layer 7 (surface layer), and the protective layer 7 is preferably a high strength protective layer (high strength surface layer). As the high strength protective layer, a layer containing a binder resin having conductive fine particles dispersed therein, a layer containing an ordinary charge transporting layer material having lubricating fine particles such as a fluorine resin, an acrylate resin, or the like dispersed therein, and a hard coating agent such as silicone, acrylate, or the like. The high strength protective layer preferably contains a siloxane-based resin having a charge transporting property and a crosslinked structure is preferred.

The protective layer 7, to which other coupling agents or fluorine compounds are added and mixed, may be used. As the compound, various silane coupling agents and commercially available silicone-based hard coating agents are used.

For preparation of a coating liquid used in forming the protective layer 7, a solvent may not be used or may be optionally used.

The reaction temperature and the reaction time vary depending on the kinds of the raw materials, but the temperature is usually from 0° C. to 100° C., preferably from 10° C. to 70° C., and particularly preferably from 15° C. to 50° C. The reaction time is not particularly limited, but it is preferably in the range from 10 minutes to 100 hours.

Examples of the curing catalyst include protonic acids such as hydrochloric acid, acetic acid, phosphoric acid, sulfuric acid, or the like, bases such as ammonia, triethylamine, and the like, organic tin compounds such as dibutyltin diacetate, dibutyltin dioctoate, stannous octoate, or the like, organic titanium compounds such as tetra-n-butyl titanate, tetraisopropyl titanate, and the like, organic aluminum compounds such as aluminum tributoxide, aluminum triacetyl acetonate, and the like, iron salts, manganese salts, cobalt salts, zinc salts, or zirconium salts of an organic carboxylic acid, and the like. Among these, a metallic compound is preferable, a metallic acetyl acetonate or acetyl acetate is further preferred, and aluminum triacetyl acetonate is still further preferred.

The amount of the curing catalyst to be used is set depending on necessity, but it is preferably from 0.1% by weight to 20% by weight, and more preferably from 0.3% by weight to 10% by weight, based on the total amount of material containing a hydrolyzable silicon substituent.

The curing temperature may be set depending on necessity, but it is preferably set to 60° C. or higher, and more preferably 80° C. or higher so as to obtain desired strength. The curing time is set depending on necessity, but it is preferably from 10 minutes to 5 hours.

Further, after carrying out the curing reaction, the cured layer may be maintained at a high humidity condition.

The layer may be subjected to a surface treatment by using hexamethylsilazane, trimethylchlorosilane, or the like depending on the applications to obtain a hydrophobic surface.

The protective layer 7 of the image holding member for an image fowling apparatus is preferably added with an antioxidant.

Furthermore, a resin which may be dissolved in an alcohol may be added to the protective layer 7 of the image holding member for an image forming apparatus.

Various particles may also be added to the protective layer 7. One kind of particles may be used or two or more kinds thereof may be used in combination. Examples of the particles include silicon-containing particles, fluorine-based particles, semi-conductive metal oxide particles, and the like.

Furthermore, oils such as silicone oil and the like may be added to the protective layer 7.

Moreover, in the case of a single-layer type photosensitive layer, the single-layer type photosensitive layer which contains a charge generating material, a charge transporting material (a charge transporting material including a compound including a partial structure represented by Formula (A), for example, a charge transporting material including at least one compound selected from the group consisting of compounds represented by Formula (I) and compounds represented by Formula (II-1)), and a binder resin may be formed. Further, the charge transporting material may include a polymer charge transporting material. As the binder resin, those exemplified above for the binder resin used in the charge generating layer 5 and the charge transporting layer 6 may be used. The content of the charge generating material in the single-layer type photosensitive layer is from 10% by weight to 85% by weight, and preferably from 20% by weight to 50% by weight. Further, the content of the charge transporting material in the single-layer type photosensitive layer is preferably from 5% by weight to 50% by weight.

As the solvent used in coating and the coating method, those mentioned above may be used. The single-layer type photosensitive layer preferably has a film thickness ranging from 5 μm to 50 μm, and more preferably from 10 μm to 40 μm.

Image Forming Apparatus

The image forming apparatus of the present exemplary embodiment includes the image holding member for an image forming apparatus of the present exemplary embodiment as described above, a charging device that charges the image holding member for an image forming apparatus, an exposure device that exposes the charged image holding member for an image forming apparatus to form an electrostatic latent image, a developing device that develops the electrostatic latent image to form a toner image, and a transferring device that transfers the toner image to a transfer medium.

Figure 4:
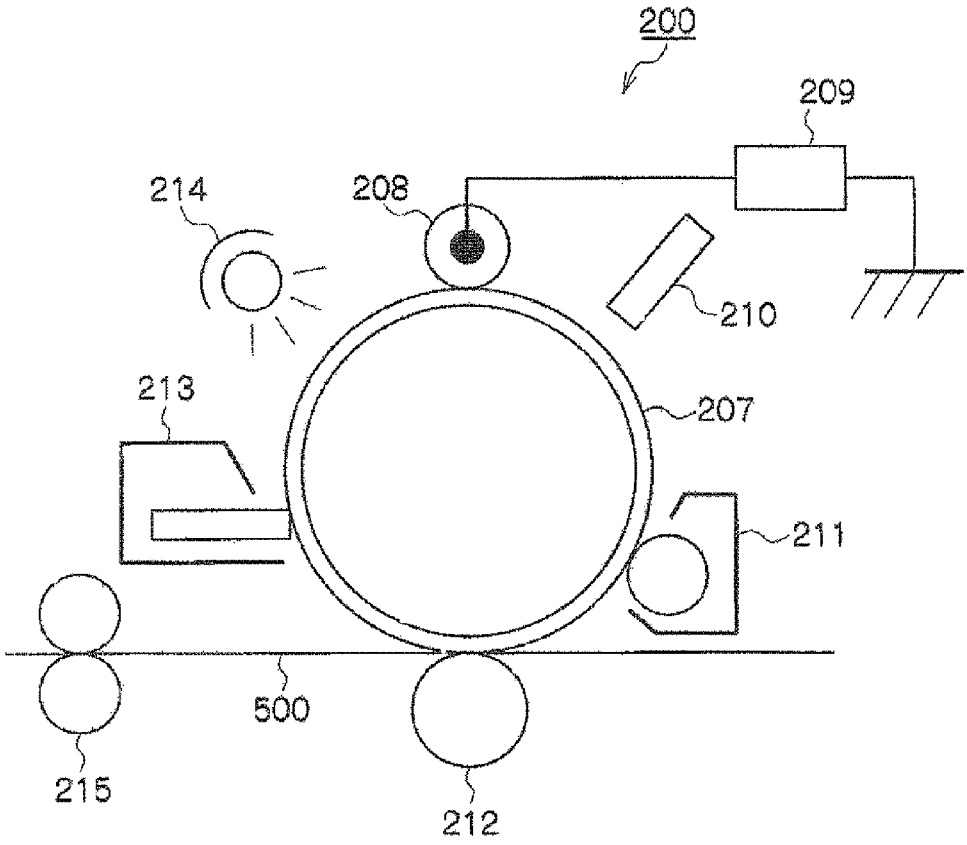
FIG. 4 is a schematic constitutional view of an image forming apparatus according to an exemplary embodiment.

FIG. 4 is a cross-sectional view schematically showing a basic structure of an exemplary embodiment of the image forming apparatus of the present exemplary embodiment.

The image forming apparatus 200 shown in FIG. 4 has the image holding member 207 for an image forming apparatus of the present exemplary embodiment, a charging device 208 for charging the image holding member 207 for an image forming apparatus by a contact type charging system, an electric power source 209 connected to the charging device 208, an exposure device 210 for exposing the image holding member 207 for an image forming apparatus which has been charged by the charging device 208 to form an electronic latent image, a developing device 211 for developing the electronic latent image which has been formed by the exposure device 210 with a toner to form a toner image, a transferring device 212 for transferring the toner image, which has been formed by the developing device 211, to a transfer body 500, a cleaning device 213, a eraser 214, and a fixing device 215.

The charging device 208 shown in FIG. 4 charges the surface of the image holding member by making a contact type charging member (for example, a charging roll) into contact with the surface of the image holding member 207 to apply a voltage to the image holding member.

As the contact type charging member, such a member having a roller form can be preferably used that has a core material having provided on an outer periphery thereof, an elastic layer, a resistor layer, a protective layer, and/or the like. The shape of the contact type charging member may be any one of a brush form, a blade form, a pin electrode form, and the like, in addition to the aforementioned roller form, and is selected depending on the specification and the form of the image forming apparatus.

The material for the core material of the contact type charging member having a roller form may be a conductive material such as iron, copper, brass, stainless steel, aluminum, nickel, and the like. Further, a resin molded product having conductive particles and the like dispersed therein may be used. The material for the elastic layer may be a material exhibiting conductivity or semiconductivity, for example, a rubber material having conductive particles or semiconductive particles dispersed therein. The materials for the resistor layer and the protective layer may be a binder resin having controlled resistance thereof by dispersing conductive particles or semiconductive particles therein.

A voltage is applied to the contact type charging member during charging the image holding member by using the contact type charging member, and the voltage thus applied may be a direct current voltage or a direct current voltage having an alternate current voltage overlapped thereon.

Further, a non-contact type corona charging device such as a corotron, a scorotron, and the like may be used instead of the contact type charging member shown in FIG. 4. The charging member is selected depending on the specification and the form of the image forming apparatus.

As the exposure device 210, for example, an optical system device capable of imagewise exposing the surface of the image holding member for an image forming apparatus by using a light source such as a semiconductor laser, an LED (light emitting diode), a liquid crystal shutter, or the like may be used.

As the developing device 211, for example, a known developing device that has been conventionally known using, for example, a one-component or two-component positive or negative developer, may be used. The shape of the toner used in the developing device 211 is not particularly limited, and a spherical toner is preferred.

The transferring device 212 may be, for example, a contact type charging member having a roller form. Examples of the transferring device further include a contact type transfer charging device using a belt, a film, a rubber blade, or the like, a scorotron transfer charging device or a corotron transfer charging device, which utilizes corona discharge, and the like.

The cleaning device 213 is provided for removing the remaining toner attached to the surface of the image holding member for an image forming apparatus after the transferring step. The image holding member for an image forming apparatus having a surface thus cleaned by the cleaning device is then repeatedly subjected to the aforementioned image forming process. The cleaning device may be, for example, a cleaning blade, a brush cleaning, a roll cleaning, or the like, and among these, a cleaning blade is preferably used. Examples of the material for the cleaning blade include urethane rubber, neoprene rubber, silicone rubber, and the like.

In the above, an image forming apparatus which is has only one image forming unit, but an image forming apparatus according to another exemplary embodiment may be a tandem type image forming apparatus having plural image forming units above.

For example, when four image forming units are provided, four color component toners, for example, yellow, magenta, cyan, and black, may be used in the four developing devices of the image forming devices, respectively. Further, the tandem type image forming apparatus is preferably provided with a belt for conveying a recording material commonly to the four image forming units, a conveying device for conveying the belt, a toner feeding device for feeding toners to the developing devices, respectively, and a fixing device for fixing a color toner image to the recording material.

Furthermore, the image forming apparatus of the present exemplary embodiment preferably includes such a system which replenish only a toner when the image holding member for an image forming apparatus is used by 200000 cycles or more, 250000 cycles or more, or 300000 cycles or more.

Process Cartridge

The process cartridge of the present exemplary embodiment may be provided with at least the image holding member for an image forming apparatus of the present exemplary embodiment as described above, and further with at least one selected from a group consisting of a charging device that charges the image holding member for an image forming apparatus, an exposure device that exposes the charged image holding member for an image forming apparatus to form an electrostatic latent image, a developing device that develops the electrostatic latent image to form a toner image, a transferring device that transfers the toner image to a transfer body, and a cleaning device that cleans the image holding member for an image forming apparatus.

Figure 5:
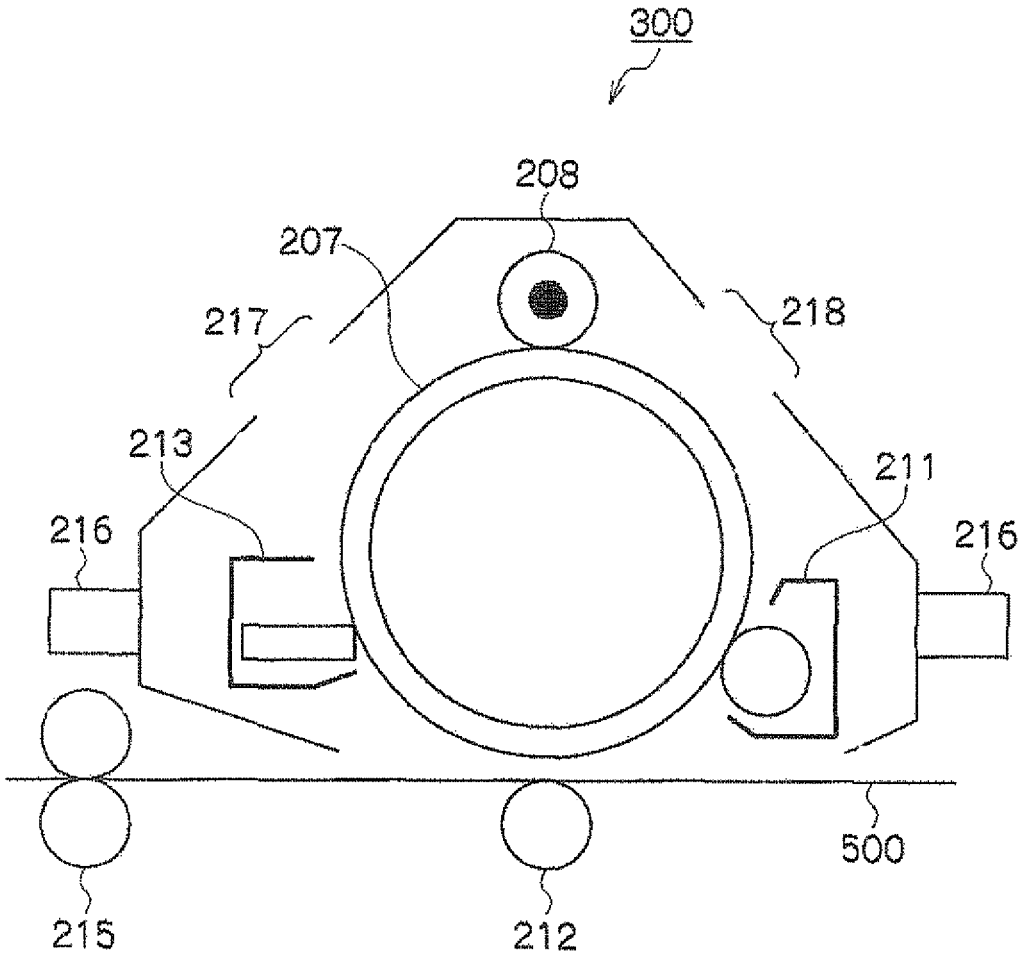
FIG. 5 is a schematic constitutional view of a process cartridge according to the exemplary embodiment.

FIG. 5 is a cross-sectional view schematically showing a basic structure of an exemplary embodiment of the process cartridge provided with the image holding member for an image forming apparatus of the present exemplary embodiment.

The process cartridge 300 has an image holding member 207 for an image forming apparatus, along with a charging device 208, a developing device 211, a cleaning device (cleaning unit) 213, an opening 218 for exposure, and an opening 217 for exposure for erasing charges, which are combined with the use of an assembly rail 216 for integration.

Furthermore, the process cartridge 300 is freely attachable to and detachable from an image forming apparatus main body including a transferring device 212 for transferring a toner image formed by the developing device 211 to a transfer body 500, a fixing device 215 and other constitutional components not shown in the figure, and constitutes an image forming apparatus together with the image forming apparatus main body.

While the present exemplary embodiments has been described above, these exemplary embodiments may have various changes or modifications within the scope of the gist.

EXAMPLE

Hereinbelow, the present invention is described with reference to Examples, but the present invention is not construed as being limited thereto.

In the present Examples, for identification of the desired matters, $^1$H-NMR spectrum (solvent: $CDCl_3$, trade name, UNITY-300 manufactured by VARIAN Co., 300 MHz), and IR spectrum (KBr method, Fourier transform infrared spectral photometer (HORIBA Ltd, FT-730, resolution 4 $cm^{-1}$) are used.

In addition, in the present Examples, the molecular weight of the polymer is measured by means of gel permeation chromatography (GPC) (HLC-8120GPC: trade name, manufactured by Tosoh Corporation).

Synthesis of Compound Represented by Formula (I) or (II-1)

Synthesis Example 1

Synthesis of Specific Exemplary Compound 4

Acetanilide (25.0 g), methyl 4-iodophenylpropionate (64.4 g), potassium carbonate (38.3 g), copper sulfate pentahydrate (2.3 g), and n-tridecane (50 ml) are put into a 500-ml 3-neck flask, followed by heating and stirring at 230° C. for 20 hours under a nitrogen gas flow. After completion of the reaction, a solution obtained by dissolving potassium hydroxide (15.6 g) in ethylene glycol (300 ml) is added thereto, followed by heating and refluxing for 3.5 hours under a nitrogen gas flow, and then cooled to room temperature (25° C.). The reaction liquid is poured into 1 L of distilled water, and neutralized with hydrochloric acid, and crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow. After the reaction, extraction with toluene is carried out and the organic phase is washed with pure water. Then, after drying over anhydrous sodium sulfate, the solvent is evaporated under reduced pressure, followed by recrystallization from hexane to obtain 36.5 g of the following DAA-1.

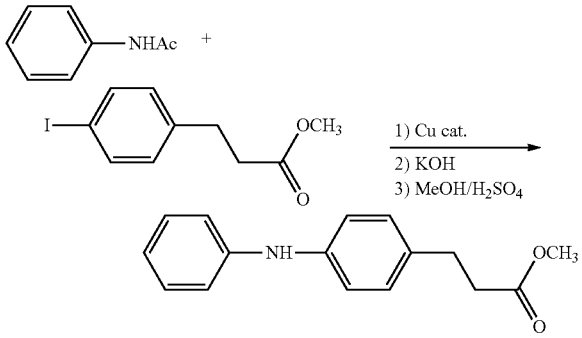

DAA-1

Next, a mixed liquid of iodobenzene (4.8 g), the DAA-1 (5.0 g), copper sulfate (II) pentahydrate (0.2 g), potassium carbonate (1.3 g), and tridecane (10 ml) is stirred at 210° C. for 7 hours. After completion of the reaction, a solution obtained by dissolving potassium hydroxide (15.6 g) in ethylene glycol (300 ml) is added thereto, followed by heating and refluxing for 3.5 hours under a nitrogen gas flow, and then cooling to room temperature (25° C.). The reaction liquid is poured into 1 L of distilled water and neutralized with hydrochloric acid, and the crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow. After cooling to room temperature (25° C.), toluene is added thereto, followed by filtration through Celite. After washing with pure water, the organic phase is extracted, the organic solvent is evaporated, and the obtained product is isolated by silica gel column chromatography (hexane 4:toluene 1) to obtain 3.9 g of the following TAA-1.

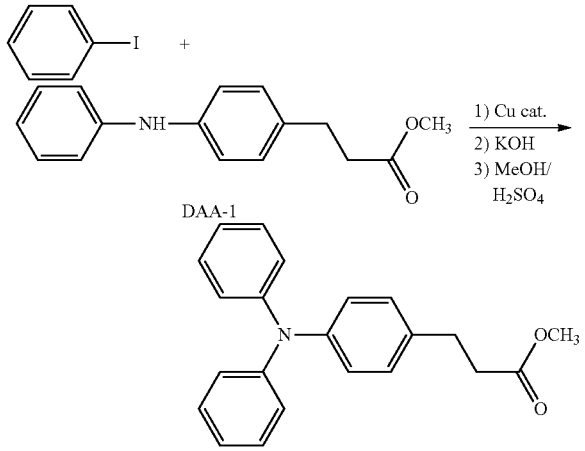

DAA-1

TAA-1

A mixed liquid of TAA-1 (3.0 g) and N,N-dimethylformamide (100 ml) is put into a 500-ml 3-neck flask, and phosphorous oxychloride (1.7 g) is added dropwise thereto, followed by warming to 80° C. and stirring for 7 hours.

After cooling, the reaction solution is added to pure water, followed by precipitation. The crystals are filtrated and collected by suction filtration to obtain 2.4 g of a formylated form of TAA-1.

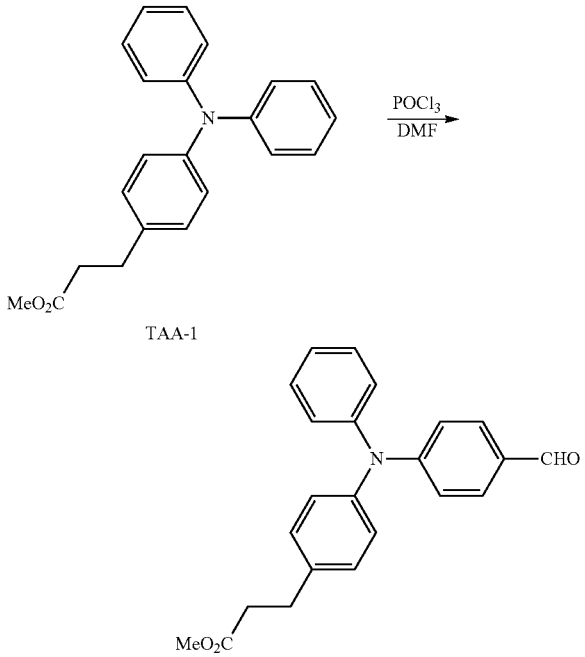

Formylated Form of TAA-1

Under a nitrogen atmosphere, a formylated form of TAA-1 (1.6 g) and 2,5-diamino-1,4-benzodithiol (0.5 g) are dissolved in m-xylene (10 ml), followed by refluxing for 15 hours. After cooling, 30 ml of THF (tetrahydrofuran) is added thereto, and the reaction solution is filtrated. The residue is purified by column chromatography (toluene:ethyl acetate=5:1) to obtain 0.6 g of Specific Exemplary Compound 4.

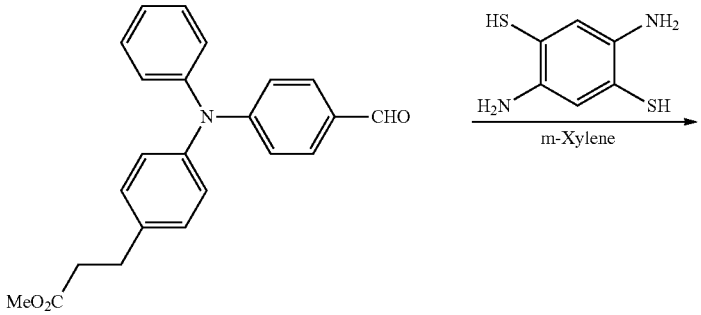

Formylated Form of TAA-1

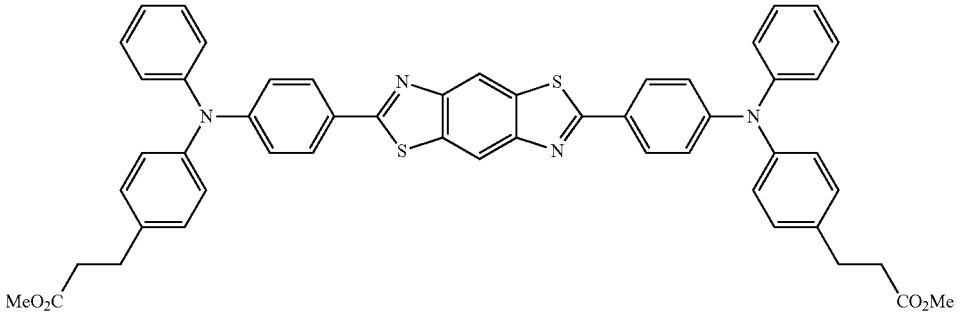

Specific Exemplary Compound 4

By $^1$H-NMR spectrum measurement and IR spectrum measurement, it is confirmed that the obtained compound is Specific Exemplary Compound 4.

Synthesis Example 2

Synthesis of Specific Exemplary Polymer 6

0.5 g of Specific Exemplary Compound 4 obtained in Synthesis Example 1 is used, and put together with 10 ml of ethylene glycol and 0.01 g of tetrabutoxytitanium into a 50-ml 3-neck round-bottom flask, followed by heating and stirring at 200° C. for 5 hours under a nitrogen atmosphere.

After confirming that the Specific Exemplary Compound 4 as a raw material has disappeared due to the reaction by means of TLC, ethylene glycol is evaporated with reduction of the pressure to 50 Pa while heating at 210° C. and keeping the reaction for 6 hours.

Thereafter, the residue is cooled to room temperature (25° C.) and dissolved in 50 ml of tetrahydrofuran, the insoluble materials are filtered over a 0.5-μl polytetrafluoroethylene (PTFE) filter, and the filtrate is evaporated under reduced pressure, then dissolved in 300 ml of monochlorobenzene, and washed with 300 ml of 1 N—HCl and 500 ml of water×3 in this order. The monochlorobenzene solution is evaporated to 30 ml under reduced pressure and added dropwise into 800 ml of ethyl acetate/methanol-1/3, and the polymer is reprecipitated.

The obtained polymer is filtered, washed with methanol, and then dried in vacuo at 60° C. for 16 hours to obtain 0.7 g of polymer (Specific Exemplary Polymer 6).

The molecular weight of this polymer is measured by means of gel permeation chromatography (GPC) (trade name: HLC-8120GPC, manufactured by Tosoh Corp.), and the weight average molecular weight Mw is $6.9\times10^4$ (in terms of styrene), Mw/Mn is 1.95, and the polymerization degree p determined from the molecular weight of the low-molecular weight compound as a raw material is 81.

Synthesis Example 3

Synthesis of Specific Exemplary Compound 23

4-(2-thienyl)acetanilide (30.0 g), methyl 4-iodophenylpropionate (28.5 g), potassium carbonate (13.6 g), copper sulfate pentahydrate (2.0 g), and 1,2-dichlorobenzene (50 ml) are put into a 500-ml 3-neck flask, and followed by heating and stirring at 230° C. for 20 hours under a nitrogen gas flow. After completion of the reaction, a solution obtained by dissolving potassium hydroxide (15.6 g) in ethylene glycol (300 ml) is added thereto, followed by heating and refluxing for 3.5 hours under a nitrogen gas flow, and cooling to room temperature (25° C.). The reaction liquid is poured into 1 L of distilled water, neutralized with hydrochloric acid, and the crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow. After the reaction, extraction with toluene is carried out and the organic phase is washed with pure water. Then, after drying over anhydrous sodium sulfate, the solvent is evaporated under reduced pressure, and the residue is recrystallized from hexane to obtain 17.9 g of DAA-2.

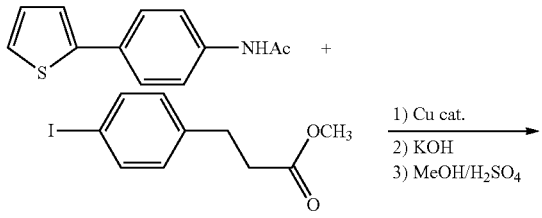

-continued

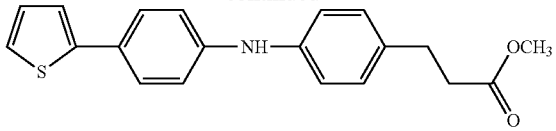

DAA-2

Under a nitrogen atmosphere, a mixed liquid of iodobenzene (3.6 g), DAA-2 (5.0 g), copper sulfate (II) pentahydrate (0.2 g), potassium carbonate (1.3 g), and tridecane (15 ml) is stirred at 210° C. for 15 hours.

After completion of the reaction, a solution obtained by dissolving potassium hydroxide (15.6 g) in ethylene glycol (300 ml) is added thereto, followed by heating and refluxing for 3.5 hours under a nitrogen gas flow, and cooling to room temperature (25° C.). The reaction liquid is poured into 1 L of distilled water, neutralized with hydrochloric acid, and the crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow.

After cooling, toluene is added thereto, followed by filtration through Celite, toluene is distilled off, and the obtained product is isolated by silica gel column chromatography (hexane 2:toluene 1) to obtain 3.2 g of TAA-2.

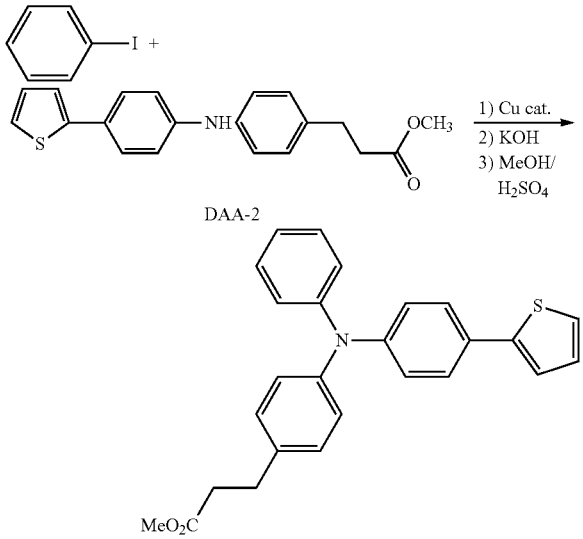

DAA-2

TAA-2

TAA-2 (3.0 g) is dissolved in N,N-dimethylformamide (5 ml), and phosphorous oxychloride is added dropwise thereto. After stirring at room temperature (25° C.) for 4 hours, anhydrous N,N-dimethylformamide (3 ml) is further added thereto, followed by further stirring magnetically for 13.5 hours. After completion of the reaction, water (100 ml) and ethyl acetate (100 ml) are put thereinto, followed by stirring, and the organic phase is separated. The organic phase is washed with 50 ml of saturated brine and dried over sodium sulfate. The solvent is evaporated, and the obtained crude product is isolated by silica gel column chromatography (ethyl acetate:hexane=1:4) to obtain 2.5 g of a formylated form of TAA-2.

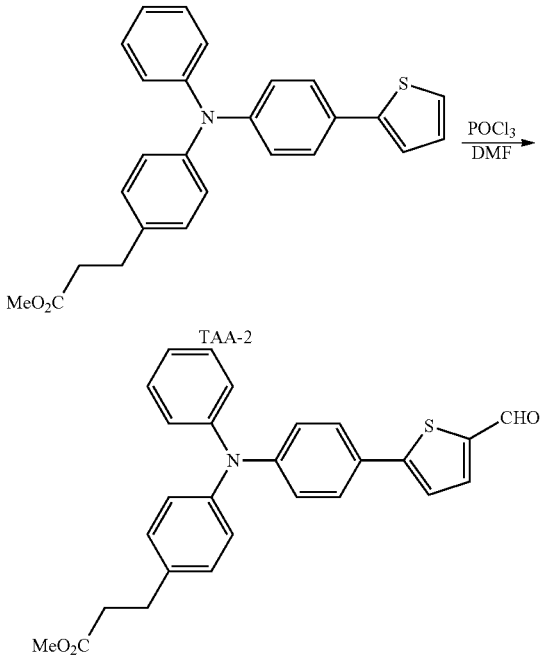

TAA-2

Formylated Form of TAA-2

A formylated form of TAA-2 (2.2 g) and 2,5-diamino-1,4-benzodithiol (0.37 g) are dissolved in N,N-dimethyl formaldehyde (15 ml), followed by refluxing for 24 hours. N,N-dimethyl formaldehyde is distilled off under reduced pressure, the obtained solid is subjected to Soxhlet extraction (6 hours) with hexane, and the impurities are removed. The obtained crude crystals are isolated by silica gel column chromatography (toluene) and recrystallized from toluene to obtain 0.45 g of Specific Exemplary Compound 23.

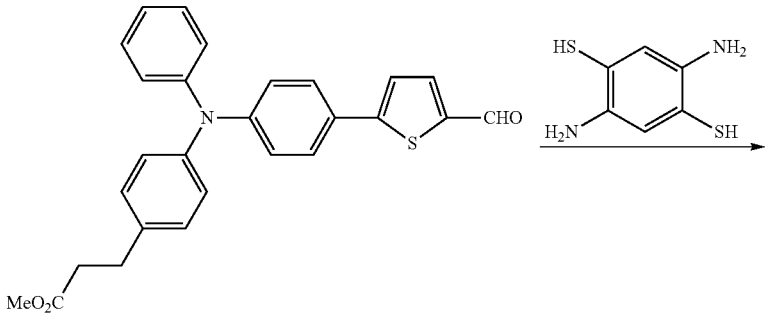

Formylated Form of TAA-2

-continued

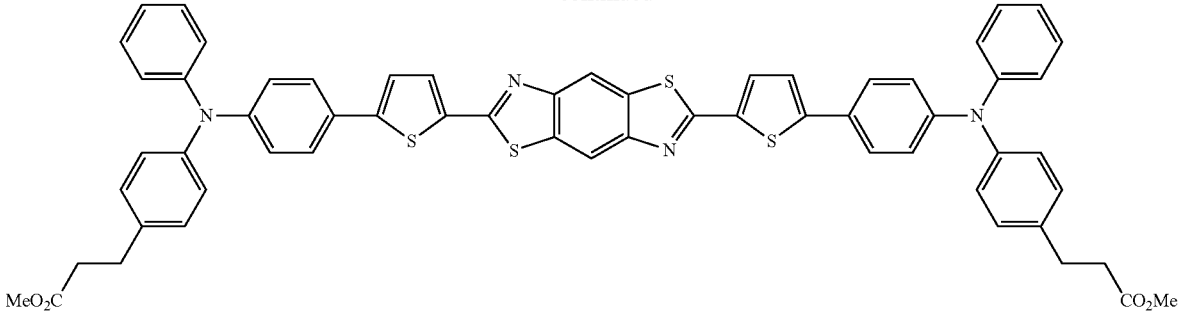

Specific Exemplary Compound 23

By $^1$H-NMR spectrum measurement and IR spectrum measurement, it is confirmed that the obtained compound is Specific Exemplary Compound 23.

Synthesis Example 4

Synthesis of Specific Exemplary Compound (5)

4-Methyl acetanilide (21.0 g), methyl 4-iodophenylpropionate (64.4 g), potassium carbonate (38.3 g), copper sulfate pentahydrate (2.3 g), and n-tridecane (50 ml) are put into a 500-ml 3-neck flask, followed by heating and stirring at 230° C. for 20 hours under a nitrogen gas flow. After completion of the reaction, a solution obtained by dissolving potassium hydroxide (15.6 g) in ethylene glycol (300 ml) is added thereto, followed by heating and refluxing for 3.5 hours under a nitrogen gas flow, and cooling to room temperature (25° C.). The reaction liquid is poured into 1 L of distilled water, neutralized with hydrochloric acid, and the crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow. After the reaction, extraction with toluene is carried out and the organic phase is washed with pure water. Then, after drying over anhydrous sodium sulfate, the solvent is evaporated under reduced pressure, and the residue is recrystallized from hexane to obtain 34.1 g of the following DAA-3.

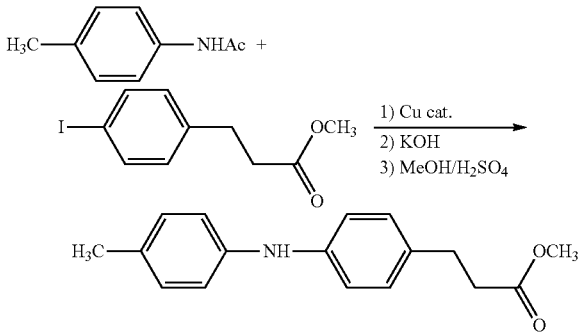

DAA-3

Next, a mixed liquid of iodobenzene (4.8 g), the DAA-3 (5.0 g), copper sulfate (II) pentahydrate (0.2 g), potassium carbonate (1.3 g), and tridecane (10 ml) is stirred at 210° C. for 7 hours. After completion of the reaction, a solution obtained by dissolving potassium hydroxide (15.6 g) in ethylene glycol (300 ml) is added thereto, followed by heating and refluxing for 3.5 hours under a nitrogen gas flow, and cooling to room temperature (25° C.). The reaction liquid is poured into 1 L of distilled water, neutralized with hydrochloric acid, and the crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow. After cooling to room temperature (25° C.), toluene is added thereto, followed by filtration through Celite. After washing with pure water, the organic phase is extracted, the organic solvent is evaporated, and the obtained product is isolated by silica gel column chromatography (hexane 4:toluene 1) to obtain 3.1 g of the following TAA-3.

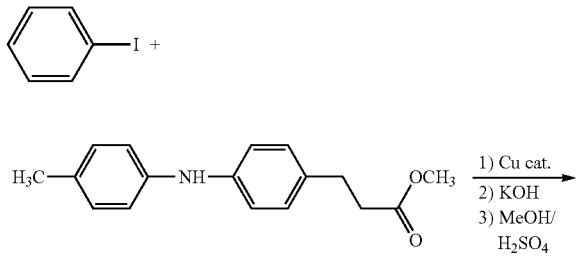

DAA-3

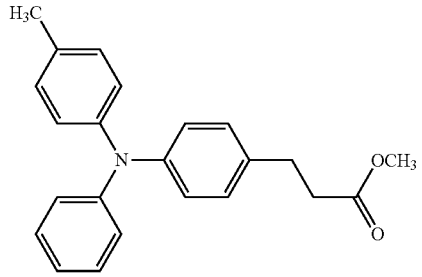

TAA-3

A mixed liquid of TAA-3 (3.0 g) and N,N-dimethylformamide (100 ml) is poured into a 500 ml 3-neck flask, and phosphorous oxychloride (1.7 g) is added dropwise, followed by warming to 80° C. and stirring for 7 hours.

After cooling, the reaction solution is added to pure water, and the precipitated crystals are filtrated and collected by suction filtration to obtain 2.7 g of a formylated form of TAA-3.

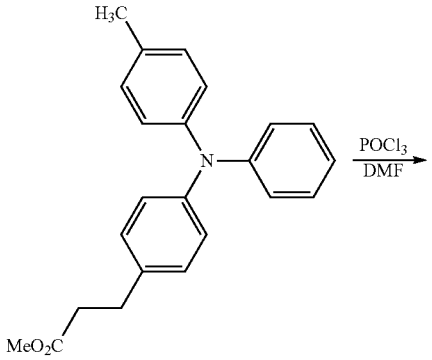

TAA-3

-continued

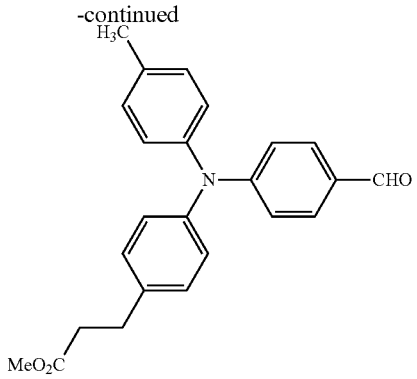

Formylated Form of TAA-3

Under a nitrogen atmosphere, a formylated form of TAA-3 (2.0 g) and 2,5-diamino-1,4-benzodithiol (0.69 g) are dissolved in m-xylene (10 ml), followed by refluxing for 20 hours. After cooling, 30 ml of THF (tetrahydrofuran) is added thereto, and the reaction solution is filtered. This is purified by column chromatography (toluene:ethyl acetate-5:1) to obtain 0.7 g of Specific Exemplary Compound 5.

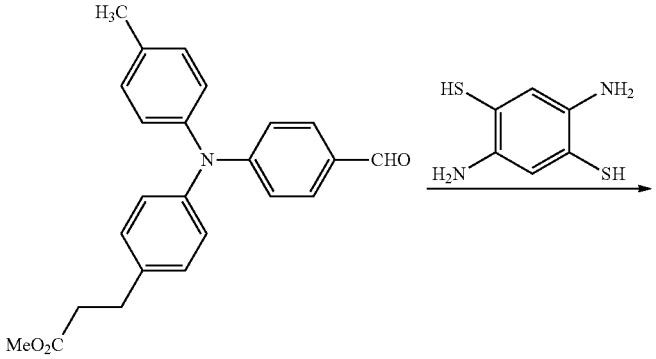

Formylated Form of TAA-3

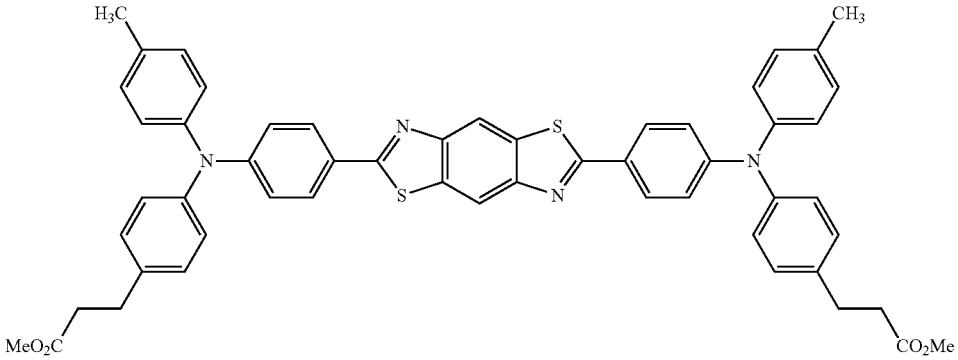

Specific Exemplary Compound 5

By $^{1}$H-NMR spectrum measurement and IR spectrum measurement, it is confirmed that the obtained compound is Specific Exemplary Compound 5.

Synthesis Example 5

Synthesis of Specific Exemplary Compound 14

1-Acetamidenaphthalene (25.0 g), methyl 4-iodophenylpropionate (64.4 g), potassium carbonate (38.3 g), copper sulfate pentahydrate (2.3 g), and n-tridecane (50 ml) are put into a 500-ml 3-neck flask, followed by heating and stirring at 230° C. for 20 hours under a nitrogen gas flow. After completion of the reaction, a solution obtained by dissolving potassium hydroxide (15.6 g) in ethylene glycol (300 ml) is added thereto, followed by heating and refluxing for 3.5 hours under a nitrogen gas flow. After cooling to room temperature, the reaction liquid is poured into 1 L of distilled water and neutralized with hydrochloric acid, and the crystals are precipitated. The crystals are filtrated and collected by suction filtration, sufficiently washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow. After the reaction, extraction with toluene is carried out, and the organic layer is sufficiently washed with pure water. Then, after drying over anhydrous sodium sulfate, the solvent is evaporated under reduced pressure, and the residue is recrystallized from hexane to obtain 36.5 g of DAA-4.

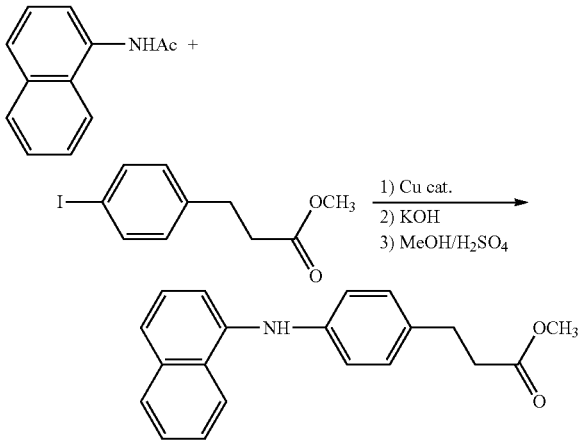

DAA-4

Next, a mixed liquid of iodobenzene (4.8 g), the DAA-4 (5.0 g), copper sulfate (II) pentahydrate (0.2 g), potassium carbonate (1.3 g), and tridecane (10 ml) is stirred at 210° C. for 7 hours. After completion of the reaction, a solution obtained by dissolving potassium hydroxide (15.6 g) in ethylene glycol (300 ml) is added thereto, followed by heating and refluxing for 3.5 hours under a nitrogen gas flow, and cooling to room temperature (25° C.). The reaction liquid is poured into 1 L of distilled water and neutralized with hydrochloric acid, and the crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow. After cooling to room temperature (25° C.), toluene is added thereto, followed by filtration through Celite. After washing with pure water, the organic phase is extracted, the organic solvent is evaporated, and the obtained product is isolated by silica gel column chromatography (hexane 4:toluene 1) to obtain 3.9 g of the following TAA-4.

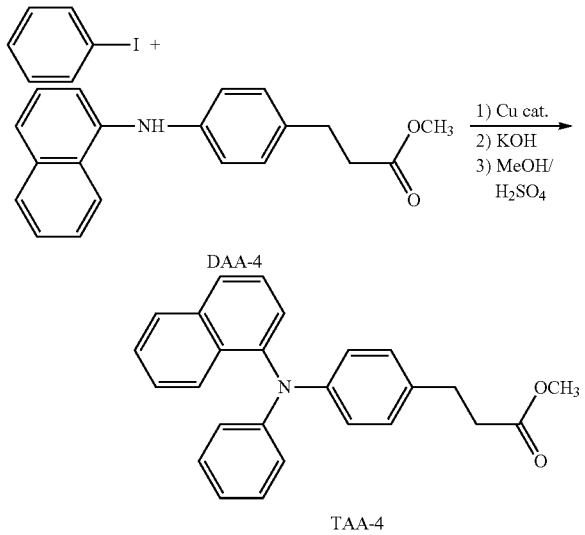

TAA-4

A mixed liquid of TAA-4 (3.0 g) and N,N-dimethylformamide (100 ml) are put into a 500-ml 3-neck flask, and phosphorous oxychloride (1.7 g) is added dropwise, followed by warming to 80° C. and stirring for 7 hours.

After cooling, the reaction solution is added to pure water, and the precipitated crystals are filtrated and collected by suction filtration to obtain 2.4 g of a formylated form of TAA-4.

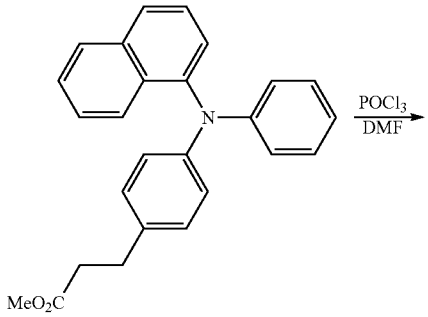

TAA-4

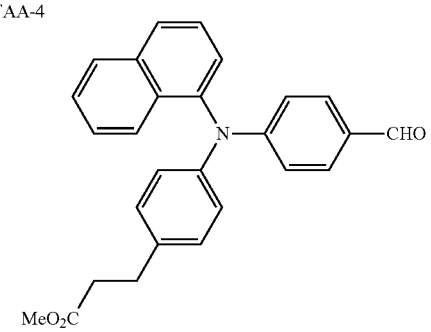

Formylated Form of TAA-4

Under a nitrogen atmosphere, a formylated form of TAA-4 (2.2 g) and 2,5-diamino-1,4-benzodithiol (0.7 g) are dissolved in m-xylene (10 ml), followed by refluxing for 28 hours. After cooling, 30 ml of THF (tetrahydrofuran) is added thereto, and the reaction solution is filtered. This is purified by column chromatography (toluene) to obtain 0.7 g of Specific Exemplary Compound 14.

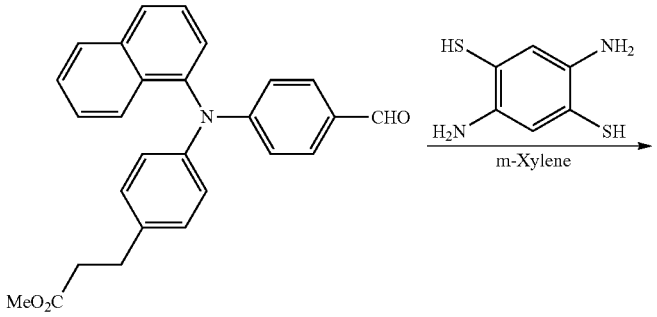

Formylated Form of TAA-4

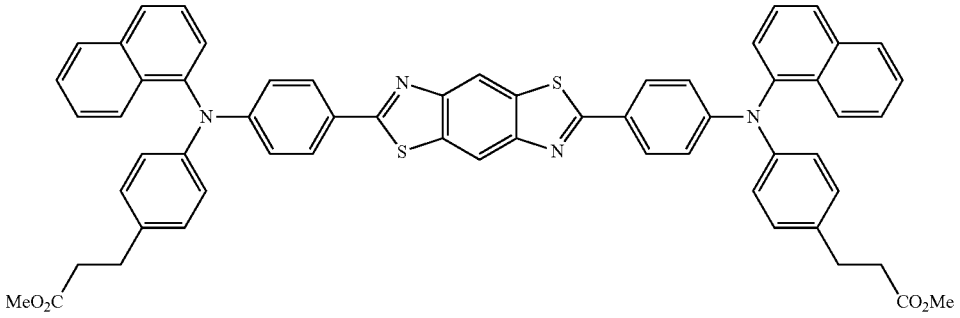

Specific Exemplary Compound 14

By $^1$H-NMR spectrum measurement and IR spectrum measurement, it is confirmed that the obtained compound is Specific Exemplary Compound 14.

Synthesis Example 6

Synthesis of Specific Exemplary Polymer 16

1.0 g of Specific Exemplary Compound 14 obtained in Synthesis Example 5 is used, and put together with 10 ml of ethylene glycol and 0.02 g of tetrabutoxytitanium to a 50-ml 3-neck round-bottom flask, followed by heating and stirring at 200° C. for 5 hours under a nitrogen atmosphere.

After confirming that the Specific Exemplary Compound 14 as a raw material has disappeared due to the reaction by means of TLC, ethylene glycol is evaporated with reduction of the pressure to 50 Pa while heating at 210° C. and keeping the reaction for 6 hours.

Thereafter, the residue is cooled to room temperature (25° C.) and dissolved in 50 ml of tetrahydrofuran, the insoluble materials are filtered over a 0.5-μl polytetrafluoroethylene (PTFE) filter, and the filtrate is evaporated under reduced pressure, then dissolved in 300 ml of monochlorobenzene, and washed with 300 ml of 1 N-HCl and 500 ml of water×3 in this order. The monochlorobenzene solution is evaporated to 30 ml under reduced pressure and added dropwise into 800 ml of ethyl acetate/methanol=1/3, and the polymer is reprecipitated.

The obtained polymer is filtered, washed with methanol, and then dried in vacuo at 60° C. for 16 hours to obtain 0.5 g of polymer (Specific Exemplary Polymer 16).

The molecular weight of this polymer is measured by means of gel permeation chromatography (GPC) (HLC-8120GPC: trade name, manufactured by Tosoh Corp.), and the weight average molecular weight Mw is $5.2\times10^4$ (in terms of styrene), Mw/Mn is 1.95, and the polymerization degree p determined from the molecular weight of the low-molecular compound as a raw material is 55.

Synthesis Example 7

Synthesis of Specific Exemplary Compound 25

4-(2-Thienyl)acetanilide (30.0 g), methyl 4-iodophenylpropionate (28.5 g), potassium carbonate (13.6 g), copper sulfate pentahydrate (2.0 g), and 1,2-dichlorobenzene (50 ml) are put into a 500-ml 3-neck flask, followed by heating and stirring at 230° C. for 20 hours under a nitrogen gas flow. After completion of the reaction, a solution obtained by dissolving potassium hydroxide (15.6 g) in ethylene glycol (300 ml) is added thereto, followed by heating and refluxing for 3.5 hours under a nitrogen gas flow, and cooling to room temperature (25° C.). The reaction liquid is poured into 1 L of distilled water and neutralized with hydrochloric acid, and the crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow. After the reaction, extraction with toluene is carried out and the organic phase is washed with pure water. Then, after drying over anhydrous sodium sulfate, the solvent is evaporated under reduced pressure, and the residue is recrystallized from hexane to obtain 17.9 g of DAA-2.

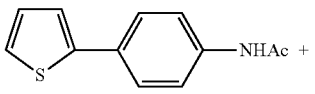

-continued

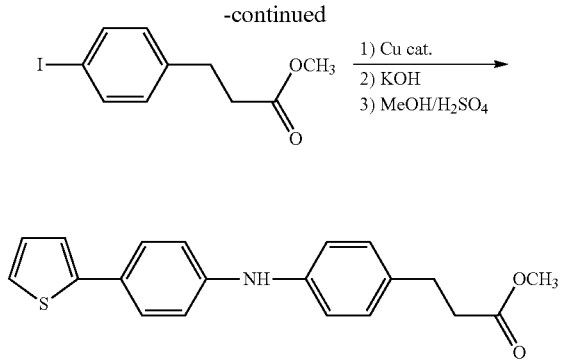

DAA-2

Under a nitrogen atmosphere, a mixed liquid of 3-methyliodobenzene (4.0 g), DAA-2 (5.0 g), copper sulfate (II) pentahydrate (0.2 g), potassium carbonate (1.3 g), and tridecane (15 ml) is stirred at 210° C. for 15 hours.

After completion of the reaction, a solution obtained by dissolving potassium hydroxide (15.6 g) in ethylene glycol (300 ml) is added thereto, followed by heating and refluxing for 3.5 hours under a nitrogen gas flow, and cooling to room temperature (25° C.). The reaction liquid is poured into 1 L of distilled water and neutralized with hydrochloric acid, and the crystals are precipitated. The crystals are filtrated and collected by suction filtration, washed with water, and then transferred to a 1-L flask. Then, toluene (500 ml) is added thereto, followed by heating and refluxing, and water is removed by azeotropy. Then, a solution of concentrated sulfuric acid (1.5 ml) in methanol (300 ml) is added thereto, followed by heating and refluxing for 5 hours under a nitrogen gas flow.

After cooling, toluene is added thereto, followed by filtration through Celite, toluene is distilled off, and the obtained product is isolated by silica gel column chromatography (hexane 2:toluene 1) to obtain 3.0 g of TAA-5.

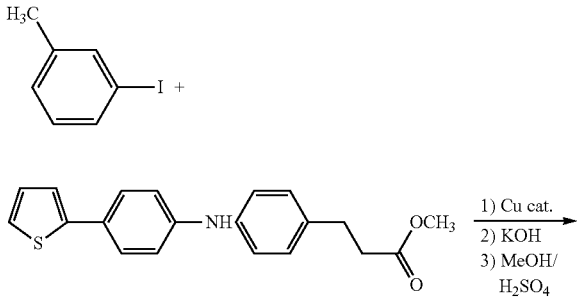

DAA-2

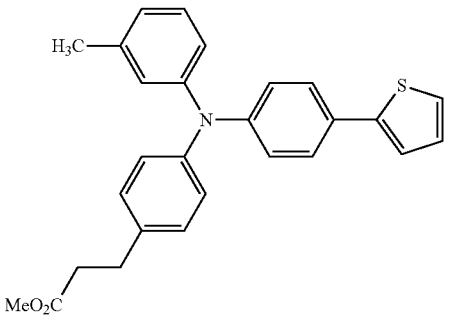

TAA-5

TAA-5 (3.0 g) is dissolved in N,N-dimethylformamide (5 ml) and phosphorous oxychloride is added dropwise. After stirring at room temperature (25° C.) for 4 hours, anhydrous N,N-dimethylformamide (3 ml) is further added thereto, followed by further stirring magnetically for 13.5 hours. After completion of the reaction, water (100 ml) and ethyl acetate (100 ml) are put thereinto, followed by stirring, and the organic phase is separated. The organic phase is washed with 50 ml of saturated brine and dried over sodium sulfate. The solvent is evaporated, and the obtained crude product is isolated by silica gel column chromatography (ethyl acetate: hexane=1:4) to obtain 2.5 g of a formylated form of TAA-5.

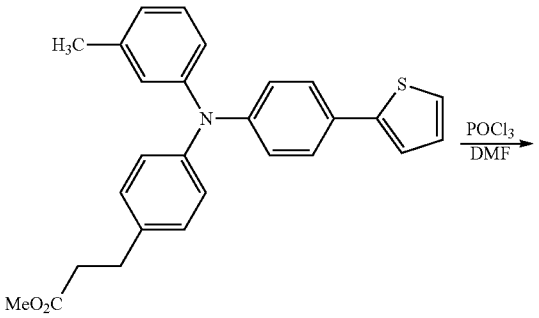

TAA-5

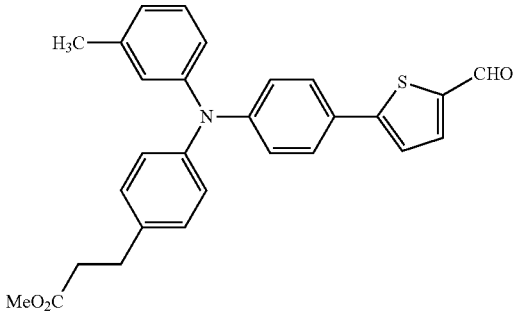

Formylated Form of TAA-5

A formylated form of TAA-5 (2.5 g) and 2,5-diamino-1,4-benzodithiol (0.7 g) are dissolved in N,N-dimethyl formaldehyde (15 ml), followed by refluxing for 30 hours. N,N-dimethyl formaldehyde is distilled off under reduced pressure, the obtained solid is subjected to Soxhlet extraction (5 hours) with hexane, and the impurities are removed. The obtained crude crystals are isolated by silica gel column chromatography (toluene) and recrystallized from toluene to obtain 0.6 g of Specific Exemplary Compound 25.

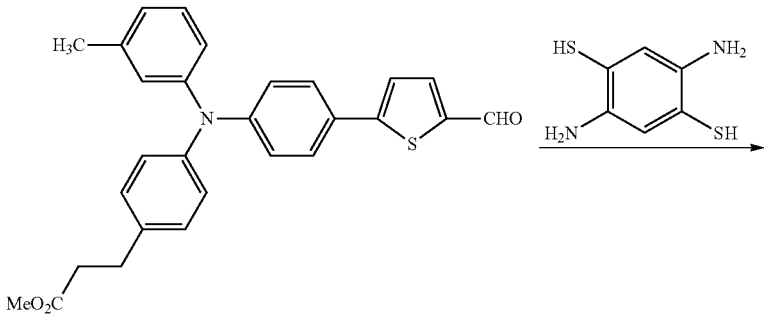

Formylated Form of TAA-5

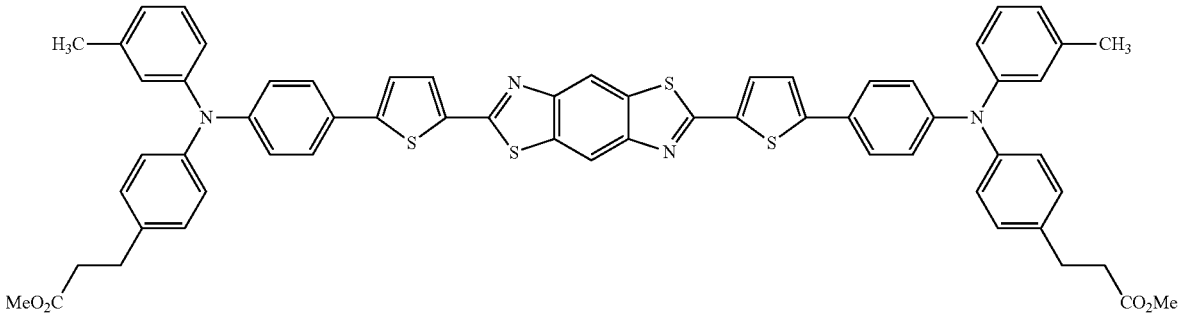

Specific Exemplary Compound 25

By $^1$H-NMR spectrum measurement and IR spectrum measurement, it is confirmed that the obtained compound is Specific Exemplary Compound 25.

Manufacture of Image Holding Member for Image Forming Apparatus

Example 1

A solution containing 10 parts by weight of a zirconium compound (trade name, ORGATICS ZC540, manufactured by Matsumoto Pharmaceutical Manufacture Co., Ltd.), 1 part by weight of a silane compound (trade name, A1110, manufactured by Nippon Unicar Co., Ltd.), 40 parts by weight of i-propanol, and 20 parts by weight of butanol is coated on an aluminum substrate by a dip coating method, and the canting is heated, and dried at 150° C. for 10 minutes to form an undercoat layer having a thickness of 0.6 μm. 1 part by weight of chlorogallium phthalocyanine crystals having distinct diffraction peaks at 7.4°, 16.6°, 25.5°, and 28.3° of Bragg angles)(2θ±0.2° in an X-ray diffraction spectrum is mixed with 1 part by weight of a polyvinyl butyral resin (trade name, S-LEC BM-S, manufactured by Sekisui Chemical Co., Ltd.) and 100 parts by weight of n-butyl acetate, and subjected to dispersing treatment in a paint shaker with glass beads for 1 hour. Then, resulting coating liquid is coated on the undercoat layer by a dip coating method, followed by heating and drying at 100° C. for 10 minutes to form a charge generating layer.

Next, 2 parts by weight of the Specific Exemplary Compound 4 obtained above and 3 parts by weight of a bisphenol (Z) polymer compound having the following structure (viscosity average molecular weight: 40,000) are dissolved in 35 parts by weight of chlorobenzene by heated, and then the solution is cooled back to room temperature (25° C.) to obtain a coating composition. This coating liquid is coated on the charge generating layer by a dip coating method, followed by heating at 130° C. for 60 minutes to form a charge transporting layer having a thickness of 20 μm.

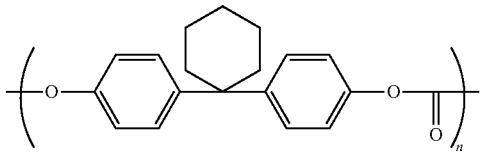

Bisphenol (Z) Polymer Compound

Example 2 to Example 7

In the same manner as in Example 1 except that Specific Exemplary Polymer 6, Specific Exemplary Compound 23, Specific Exemplary Compound 5, Specific Exemplary Compound 14, Specific Exemplary Polymer 16, and Specific Exemplary Compound 25 are used instead of the Specific Exemplary Compound 4 used in Example 1, an image holding members for an image forming apparatus are prepared, respectively.

Example 8

In the same manner as in Example 1 except that hydroxygallium phthalocyanine crystals having distinct diffraction peaks at 7.5°, 9.9°, 12.5°, 16.3°, 18.6°, 25.1°, and 28.3° of Bragg angles (2θ±0.2°) in an X-ray diffraction spectrum are used instead of chlorogallium phthalocyanine crystals used in Example 1, an image holding member for an image forming apparatus is prepared.

Comparative Example 1

By the method described in Example 1 except that a compound (X) having the following structure is used instead of the Specific Exemplary Compound 4 used in Example 1, an image holding member for an image forming apparatus is prepared.

(X)

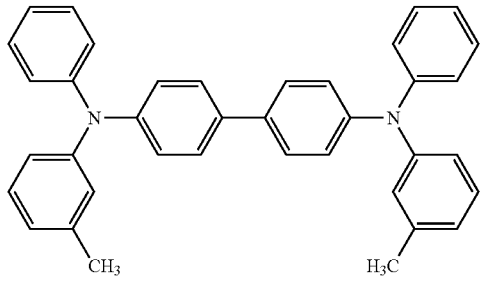

Comparative Example 2

By the method described in Example 1 except that a compound (XI) (p=52) having the following structure is used instead of the Specific Exemplary Compound 4 used in Example 1, an image holding member for an image forming apparatus is prepared.

(XI)

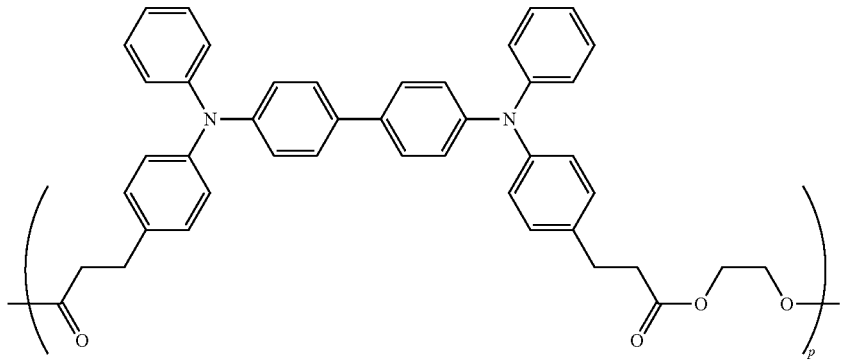

Comparative Example 3

By the method described in Example 1 except that a compound (XII) having the following structure is used instead of the Specific Exemplary Compound 4 used in Example 1, an image holding member for an image forming apparatus is prepared.

(XII)

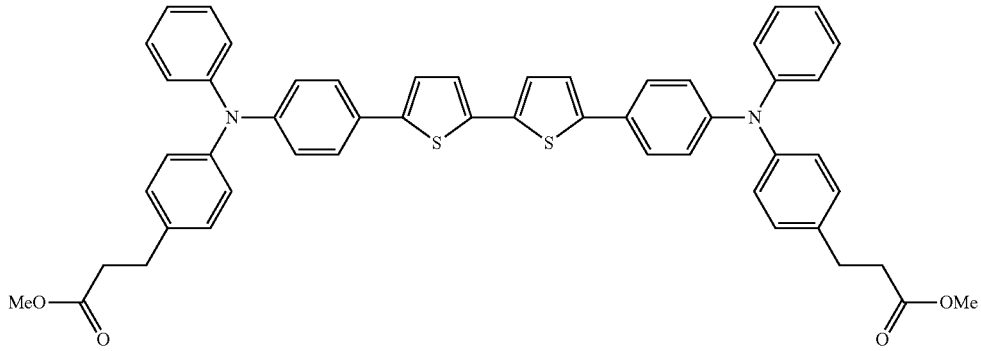

Comparative Example 4

By the method described in Example 1 except that a compound (XIII) (p=82) having the following structure is used instead of the Specific Exemplary Compound 4 used in Example 1, an image holding member for an image forming apparatus is prepared, (XIII)

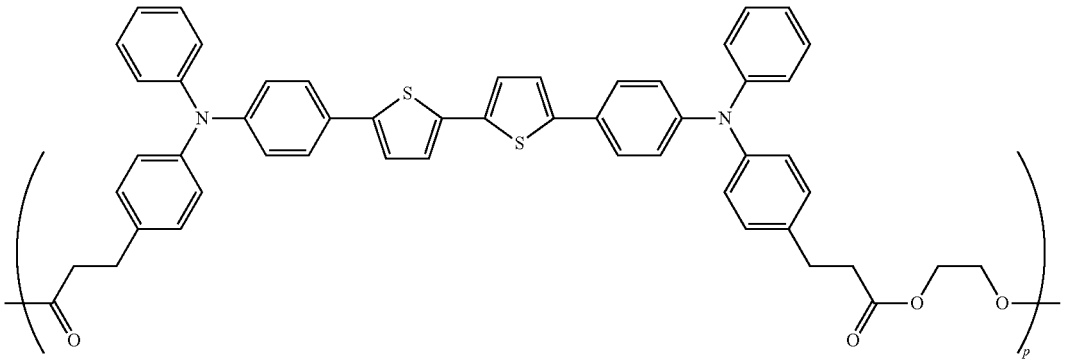

Evaluation

In order to evaluate the electrophotographic characteristics using each of the image holding members for an image forming apparatuses obtained in Examples and Comparative Examples above, by using an electrostatic copying paper tester (trade name, ELECTROSTATIC ANALYZER EPA-8100, manufactured by Kawaguchi Electric Works Co., Ltd.), the image holding members are charged by corona discharging of −6 KV under the environment of 20° C. and 40% RH. Thereafter, using a monochrometer, light from a tungsten lamp is adjusted to be monochrome light at 800 nm, and the monochrome light which is adjusted to attain 1 $\mu W/cm^2$ on the photoreceptor surface is irradiated.

Then, the surface potential $V_0$(V) of the photoreceptor surface immediately after charging and the half exposure amount E1/2 ($erg/cm^2$) at which the surface potential is made to become $1/2\times V_0$(V) by irradiation onto the photoreceptor surface are measured (initial characteristics). Thereafter, the photoreceptor is irradiated with white light at 10 lux for 1 second and the residual potential VRP (V) that remained on the photoreceptor surface is measured (initial characteristics).

Furthermore, after repeating the above-described procedures of charging, exposing (monochrome light at 800 nm and a half exposure amount taken as the exposure amount), and irradiation with white light (10 lux) 1,000 times, $V_0$, E1/2, and VRP are measured, and the change amounts thereof $\Delta V_0$, $\Delta$E1/2, and $\Delta$VRP, are evaluated (stability, durability).

Next, by using the image holding members for an image fowling apparatus obtained in Examples and Comparative Examples above, image forming apparatuses are manufactured. As other components besides the image holding member for an image forming apparatus, those mounted on PRINTER DOCUCENTER C6550I, trade name, manufactured by Fuji Xerox Co., Ltd. are used For each image forming apparatus, an image forming test is carried out on 10,000 sheets (image density 10%, cyan 100%) under an environment of 28° C. and 75% RH. Further, under these test conditions, the process of each cartridge is routinely carried out, but toners of the cartridges other than cyan are not used (supplied). After testing, the cleaning property of the toner (staining of the charging device due to poor cleaning or deterioration in the image quality), the image quality (fine line reproducibility at 1 dot process black and line slope 45) are evaluated. The evaluation method and the evaluation criteria for the cleaning property and the image quality are as follows and the obtained results are shown in Table 1.

The cleaning property is evaluated by visual observation and evaluated in accordance with the following evaluation criteria.

A: Good

B: Partially having stripe-shape image defects (about 10% or less of the total)

C: Having stripe-shape image defects over a wide area

The image quality is examined using a magnifying glass and evaluated in accordance with the following evaluation criteria.

A: Good

B: Partially having defects (practically non-problematic)

C: Having defects (fine lines not being reproduced)

| | Initial characteristics (first time) | | | Maintenance characteristics (characteristics after 1000-times repetition) | | | Safety | Durability | | | |
|---|---|---|---|---|---|---|---|---|---|---|---|
| Example | $V_0$ (V) | E½ ($erg/cm^2$) | VRP (V) | $V_0$ (V) | E½ ($erg/cm^2$) | VRP (V) | $\Delta$E½ ($erg/cm^2$) | $\Delta V_0$ (V) | $\Delta$VRP (V) | Cleaning property | Image quality |
| Ex. 1 | −795 | 2.4 | −12 | −783 | 2.9 | −20 | 0.5 | 12 | 10 | A | A |
| Ex. 2 | −801 | 2.4 | −12 | −790 | 2.8 | −21 | 0.4 | 11 | 11 | A | A |
| Ex. 3 | −805 | 2.4 | −11 | −793 | 2.8 | −22 | 0.4 | 11 | 12 | A | A |
| Ex. 4 | −800 | 2.5 | −10 | −790 | 2.8 | −21 | 0.3 | 10 | 10 | A | A |
| Ex. 5 | −794 | 2.4 | −12 | −782 | 2.7 | −21 | 0.3 | 12 | 9 | A | A |
| Ex. 6 | −802 | 2.4 | −11 | −791 | 2.8 | −22 | 0.4 | 11 | 11 | A | A |
| Ex. 7 | −798 | 2.4 | −11 | −787 | 2.8 | −21 | 0.4 | 11 | 10 | A | B |

-continued

| Example | Initial characteristics (first time) $V_0$ (V) | E½ (erg/cm²) | VRP (V) | Maintenance characteristics (characteristics after 1000-times repetition) $V_0$ (V) | E½ (erg/cm²) | VRP (V) | Safety ΔE½ (erg/cm²) | Durability ΔV₀ (V) | ΔVRP (V) | Cleaning property | Image quality |
|---|---|---|---|---|---|---|---|---|---|---|---|
| Ex. 8 | −808 | 2.4 | −10 | −796 | 2.8 | −21 | 0.4 | 12 | 11 | A | A |
| Comp. Ex. 1 | −815 | 2.4 | −14 | −796 | 2.9 | −26 | 0.5 | 19 | 12 | B | C |
| Comp. Ex. 2 | −803 | 2.4 | −15 | −785 | 2.9 | −29 | 0.5 | 18 | 14 | B | C |
| Comp. Ex. 3 | −808 | 2.3 | −15 | −787 | 3.0 | −31 | 0.7 | 21 | 16 | B | C |
| Comp. Ex. 4 | −815 | 2.3 | −14 | −795 | 2.9 | −29 | 0.6 | 20 | 15 | B | C |

From the results as described above, it can be seen that when using the image holding members for an image forming apparatus obtained in the Examples, a residual potential variance due to repeated use is small, as compared with the image holding members of Comparative Examples. Also, it can be seen that the images obtained by the image forming apparatuses including the image holding member for an image forming apparatus of Examples also have good image quality.

The foregoing description of the exemplary embodiments of the present invention has been provided for the purposes of illustration and description. It is not intended to be exhaustive or to limit the present invention to the precise forms disclosed. Obviously, many modifications and variations will be apparent to practitioners skilled in the art. The exemplary embodiments are chosen and described in order to best explain the principles of the present invention and its practical applications, thereby enabling others skilled in the art to understand the present invention for various exemplary embodiments and with the various modifications as are suited to the particular use contemplated.

What is claimed is:

1. An image holding member for an image forming apparatus, the image holding member comprising:

a support; and a photosensitive layer disposed on or above the support, the photosensitive layer including a compound including a partial structure represented by following Formula (A):

Formula (A)

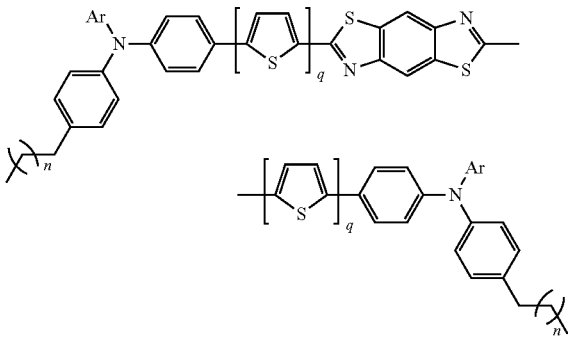

wherein, in Formula (A), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and each n independently represents an integer of from 0 to 7.

2. The image holding member for an image forming apparatus according to claim 1, wherein the compound including a partial structure represented by Formula (A) is a compound represented by following Formula (I):

Formula (I)

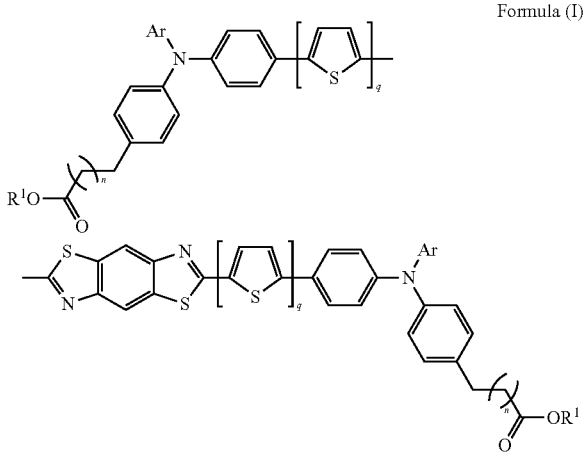

wherein, in Formula (I), each $R^1$ independently represents a substituted or unsubstituted linear or branched alkyl group having from 1 to 8 carbon atoms; Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and each n independently represents an integer of from 0 to 7.

3. The image holding member for an image forming apparatus according to claim 1, wherein the compound including a partial structure represented by Formula (A) is a compound represented by following Formula (II-1):

Formula (II-1)

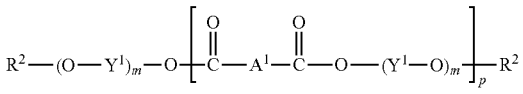

wherein, in Formula (II-1), each $Y^1$ independently represents a substituted or unsubstituted divalent hydrocarbon group; $A^1$ represents a group represented by following Formula (II-2); each $R^2$ independently represents a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, a substituted or unsubstituted monovalent linear hydrocarbon group having 1 to 6 carbon atoms, a substituted or unsubstituted monovalent branched hydrocarbon group having from 2 to 10 carbon atoms, or a hydrogen atom; each m independently represents an integer of from 1 to 5; and p represents an integer of from 5 to 5,000:

Formula (II-2)

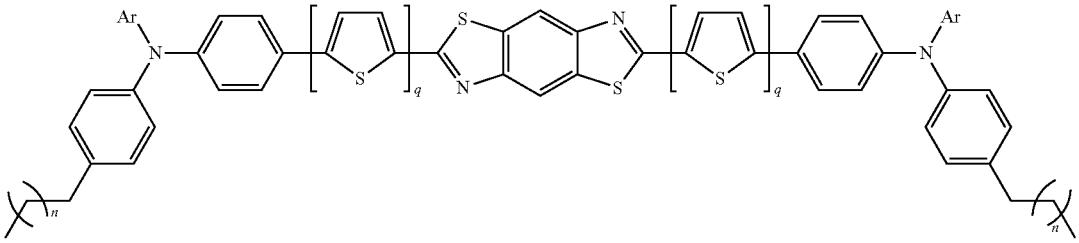

wherein, in Formula (II-2), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and each n independently represents an integer of from 0 to 7.

4. A process cartridge comprising:

the image holding member for an image forming apparatus according to claim 1; and at least one selected from the group consisting of a charging device that charges the image holding member for an image forming apparatus, an exposure device that exposes the charged image holding member for an image forming apparatus to form an electrostatic latent image, a developing device that develops the electrostatic latent image to form a toner image, a transfer device that transfers the toner image to a transfer medium, and a cleaning device that cleans the image holding member for an image forming apparatus.

5. An image forming apparatus comprising:

the image holding member for an image forming apparatus according to claim 1;

a charging device that charges the image holding member for an image forming apparatus;

an exposure device that exposes the charged image holding member for an image forming apparatus to form an electrostatic latent image;

a developing device that develops the electrostatic latent image to form a toner image; and a transfer device that transfers the toner image to a transfer medium.

* * * * *